US012274350B2

(12) United States Patent
Wang et al.

(10) Patent No.: US 12,274,350 B2
(45) Date of Patent: Apr. 15, 2025

(54) MOBILE DEVICE ATTACHMENT AND CONTAINER FOR FOOD OR LIQUID

(71) Applicant: EVOLUTIVE LABS CO., LTD., Taipei (TW)

(72) Inventors: Ching-Fu Wang, Taichung (TW); Ching-Yu Wang, Taichung (TW); Che-Wei Hsu, Taichung (TW); Jui-Chen Lu, Taichung (TW); Cheng-Che Ho, Taichung (TW)

(73) Assignee: EVOLUTIVE LABS CO., LTD., Taipei (TW)

( * ) Notice: Subject to any disclaimer, the term of this patent is extended or adjusted under 35 U.S.C. 154(b) by 56 days.

(21) Appl. No.: 18/499,239

(22) Filed: Nov. 1, 2023

(65) Prior Publication Data

US 2024/0148129 A1 May 9, 2024

Related U.S. Application Data

(60) Provisional application No. 63/458,172, filed on Apr. 10, 2023, provisional application No. 63/458,171, (Continued)

(30) Foreign Application Priority Data

| | | |
|---|---|---|
| Jan. 18, 2023 | (TW) | 112102450 |
| Aug. 17, 2023 | (TW) | 112130901 |
| Sep. 5, 2023 | (TW) | 112133739 |

(51) Int. Cl.

| | |
|---|---|
| ***A45F 4/00*** | (2006.01) |
| ***A45F 3/16*** | (2006.01) |

(52) U.S. Cl.
CPC ..... *A45F 4/00* (2013.01); *A45F 3/16* (2013.01); *A45F 2004/003* (2013.01)

(58) Field of Classification Search
CPC ..... A45F 4/00; A45F 3/16; A45F 2004/003; H01F 7/00
(Continued)

(56) References Cited

U.S. PATENT DOCUMENTS

| | | | | |
|---|---|---|---|---|
| 9,668,597 | B2 | 6/2017 | Ni | |
| 12,031,669 | B2 * | 7/2024 | Whitten | A45F 5/10 |

(Continued)

FOREIGN PATENT DOCUMENTS

| | | | |
|---|---|---|---|
| CN | 209498990 | U | 10/2019 |
| CN | 214731303 | U | 11/2021 |

(Continued)

*Primary Examiner* — Todd M Epps

(57) ABSTRACT

A mobile device attachment adapted for a mobile device and a container for food or liquid is provided. The mobile device attachment includes a magnetic connecting member and a connecting member. The magnetic connecting member is selectively magnetically connected to the mobile device and adapted to extend in an escaping direction. The connecting member is disposed between the container and the magnetic connecting member. The mobile device has an image capturing range. When the magnetic connecting member extends in the escaping direction, the container, the magnetic connecting member and the connecting member are located outside the image capturing range. Besides, a container including the mobile device attachment is also provided.

23 Claims, 34 Drawing Sheets

Related U.S. Application Data filed on Apr. 10, 2023, provisional application No. 63/423,067, filed on Nov. 7, 2022.

(58) Field of Classification Search
USPC ..... 248/206.5, 309.4
See application file for complete search history.

(56) References Cited

U.S. PATENT DOCUMENTS

| | | | | |
|---|---|---|---|---|
| 12,089,727 | B2 * | 9/2024 | Liu | A45F 5/10 |
| 12,207,716 | B1 * | 1/2025 | Li | F16M 11/041 |
| 2011/0192857 | A1 | 8/2011 | Rothbaum et al. | |
| 2017/0013950 | A1 | 1/2017 | Rieger | |
| 2017/0245624 | A1 | 8/2017 | Neves | |
| 2018/0228280 | A1 | 8/2018 | Li et al. | |
| 2019/0075914 | A1 | 3/2019 | Teper et al. | |
| 2021/0179321 | A1 | 6/2021 | Karbakhsh | |
| 2021/0204664 | A1 | 7/2021 | Fromme | |
| 2022/0055798 | A1 | 2/2022 | Morris et al. | |
| 2023/0233006 | A1 | 7/2023 | Alves et al. | |

FOREIGN PATENT DOCUMENTS

| | | | |
|---|---|---|---|
| CN | 214964318 | U | 12/2021 |
| CN | 217022385 | U | 7/2022 |
| CN | 217659136 | U | 10/2022 |
| CN | 218605521 | U | 3/2023 |
| DE | 202023105647 | U1 | 10/2023 |
| TW | 201615515 | A | 5/2016 |

* cited by examiner

MOBILE DEVICE ATTACHMENT AND CONTAINER FOR FOOD OR LIQUID

CROSS-REFERENCE TO RELATED APPLICATION

This non-provisional application claims priority under 35 U.S.C. § 119(a) on Patent Application No(s). 112102450, 112130901 and 112133739 filed in Taiwan, R.O.C. respectively on Jan. 18, 2023, Aug. 17, 2023 and Sep. 5, 2023, the entire contents of which are hereby incorporated by reference.

This non-provisional application claims priority under 35 U.S.C. § 119(e) on U.S. provisional Patent Application No(s). 63/423,067, 63/458,171 and 63/458,172 respectively filed on Nov. 7, 2022, Apr. 10, 2023 and Apr. 10, 2023, the entire contents of which are hereby incorporated by reference.

BACKGROUND OF THE INVENTION

1. Field of the Invention

The present disclosure provides a mobile device attachment and a container, and in particular relates to a mobile device attachment and a container for food or liquid that can magnetically connect the mobile device and prevent an image capturing range from being obscured at the same time.

2. Description of the Related Art

Mobile devices are one of the indispensable daily necessities of people in today's society, such as smart phones, tablets, smart watches and e-book readers, etc., which bring great convenience to people's life and work. Taking fitness as an example, when users tape videos of their movements through smartphones, they need to free their hands and do not have time to operate the phone. For this reason, some manufacturers offer mobile device attachments that can magnetically connect or attach smartphones on walls or equipment, allowing users to temporarily fix mobile phones and tape videos while operating the equipment with both hands.

BRIEF SUMMARY OF THE INVENTION

However, most smartphones on the market today have both a front lens and a main lens on the back, and the main lens has a higher resolution and shooting function than the front lens. Therefore, when the mobile phone is magnetically connected or attached on walls through the attachment disposed on the back, it will have a disguised restriction that the user can only use the front lens with lower shooting performance to tape videos, reducing the quality of the videos. On the other hand, even if the mobile phone is magnetically connected or attached on the equipment and can shoot with the main lens, because these attachments cannot provide enough shooting space for the mobile phone, when the user shoots in a wide-angle mode or even a normal mode, a part of the equipment or attachments is easy to enter the shooting range and obscure the subject, causing inconvenience in use.

Aspects and advantages of embodiments of the present disclosure will be set forth in part in the following description, or may be learned from the description, or may be learned through practice of the embodiments.

An example aspect of the present disclosure is directed to a mobile device attachment adapted for a mobile device and a container for food or liquid. The mobile device attachment includes a magnetic connecting member and a connecting member. The magnetic connecting member is selectively magnetically connected to the mobile device and adapted to extend in an escaping direction. The connecting member is disposed between the container and the magnetic connecting member. The mobile device has an image capturing range. When the magnetic connecting member extends in the escaping direction, the container, the magnetic connecting member and the connecting member are located outside the image capturing range.

In one implementation, the mobile device attachment further includes an extending member. The extending member is disposed between the magnetic connecting member and the connecting member, and adapted to extend in the escaping direction.

In one implementation, the extending member is detachably or pivotally connected to the connecting member.

In one implementation, the extending member includes a first end part and a second end part spaced from the first end part. The first end part is pivoted to the magnetic connecting member, and the second end part is pivoted or detachably connected to the connecting member.

In one implementation, the extending member is selectively passing through or sleeved on the connecting member.

In one implementation, the extending member has a plurality of positioning parts. The connecting member includes a positioning feature, and the positioning feature is selectively engaged with one of the positioning parts.

In one implementation, the mobile device attachment further includes a positioning member. The extending member has a positioning part. The connecting member has a positioning feature slidably connected to the positioning part, and the positioning member is adapted to fix the extending member relative to the connecting member.

In one implementation, one of the extending member and the magnetic connecting member has an accommodating part, and the accommodating part is adapted for accommodating at least a portion of the other one of the extending member and the magnetic connecting member.

In one implementation, the extending member includes a plurality of pipe parts, these pipe parts are sleeved with each other, and adapted to unfold or fold along the escaping direction.

In one implementation, the extending member is adapted to be magnetically connected to the magnetic connecting member or the mobile device.

In one implementation, the extending member has flexibility.

In one implementation, the container includes a mounting member. The connecting member is disposed on the mounting member, and the extending member or the magnetic connecting member is selectively attached on one surface of the mounting member.

In one implementation, the magnetic connecting member includes an extending part, and the extending part extends in the escaping direction.

In one implementation, the mobile device has a magnetic connecting feature. The magnetic connecting member further includes a first magnetic connecting part and a second magnetic connecting part. The extending part is disposed between the first magnetic connecting part and the second magnetic connecting part. The magnetic connecting feature is selectively magnetically connected to the first magnetic connecting part or the second magnetic connecting part.

In one implementation, the connecting member includes a fastening part, and the fastening part is adapted to be detachably disposed on the container.

In one implementation, the magnetic connecting member includes a magnetic connecting part and a first combination part. The magnetic connecting part is configured to be selectively magnetically connected to the mobile device. The first combination part is pivoted to the magnetic connecting part. The connecting member further includes a second combination part connected to the fastening part, and the second combination part is adapted to detachably assemble with the first combination part.

In one implementation, the fastening part is elastic, and includes a first end and a second end, and a clearance is selectively formed between the first end and the second end.

In one implementation, the magnetic connecting member has a first surface and a second surface opposite to the first surface, and the mobile device is selectively attached on the first surface or the second surface.

Another example aspect of the present disclosure is directed to a container for food or liquid. The container includes a mounting member and the mobile device attachment, and the connecting member is disposed on the mounting member.

In one implementation, the mounting member forms a groove thereon, and the groove is adapted to accommodate at least a portion of the magnetic connecting member.

In one implementation, the mobile device attachment further includes an extending member. The extending member is disposed between the magnetic connecting member and the connecting member. The mounting member forms a groove thereon, and the groove is adapted to accommodate at least a portion of the extending member.

In one implementation, a top of the mounting member in the escaping direction is located outside the image capturing range.

In one implementation, the connecting member is disposed on the top.

In order to facilitate the above features and advantages of the present disclosure to be more obvious and easy to understand, embodiments specially given together with the attached drawings for the detailed description of the present disclosure are provided as below.

DETAILED DESCRIPTION OF THE INVENTION

Figure 1:
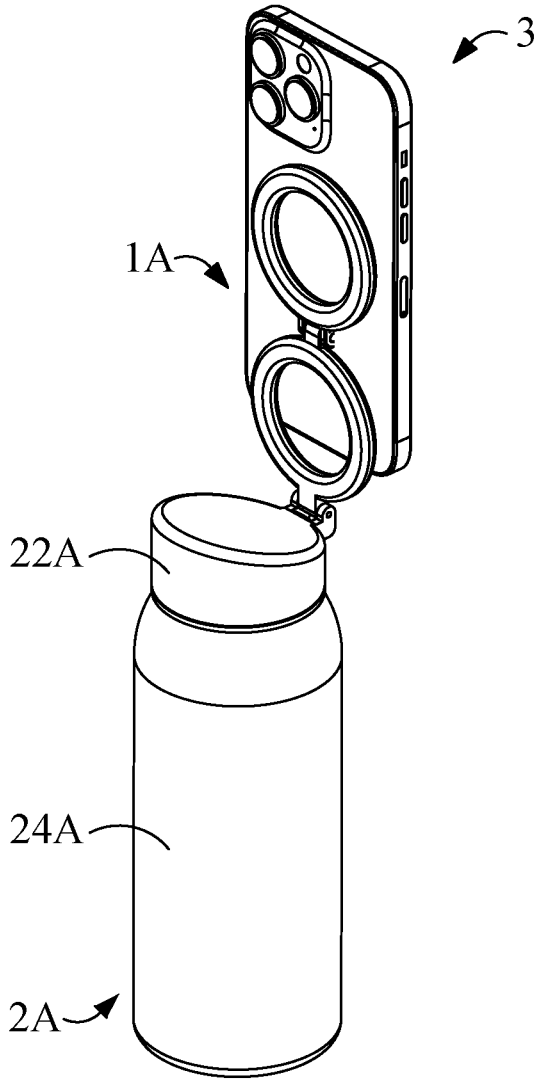
FIG. 1 is a schematic perspective view when a mobile device attachment and a container for food or liquid are synergistic with a mobile device of an embodiment.

The aforementioned and other technical contents, characteristics and effects of the present disclosure can be clearly presented by the detailed description of preferable embodiments together with the attached drawings. It is worth mentioning that the direction terms mentioned in the following embodiments, such as: top, bottom, left, right, front or rear are only referred to the direction of the drawings. Therefore, the directional terms used are intended to illustrate, not to limit, the disclosure. In addition, in the following embodiments, the same or similar components will use the same or similar reference numerals.

Referring to FIG. 1, FIG. 1 is a schematic perspective view when a mobile device attachment and a container for food or liquid are synergistic with a mobile device of an embodiment of the present disclosure. The mobile device attachment 1A is adapted for a container 2A and a mobile device 3, wherein the container 2A, for example, is a kettle, but may also be a thermos, pot or jar or other containers. The mobile device 3, for example, is a smartphone, but may also be a tablet or other electronic device with photographic functions.

Figure 2:
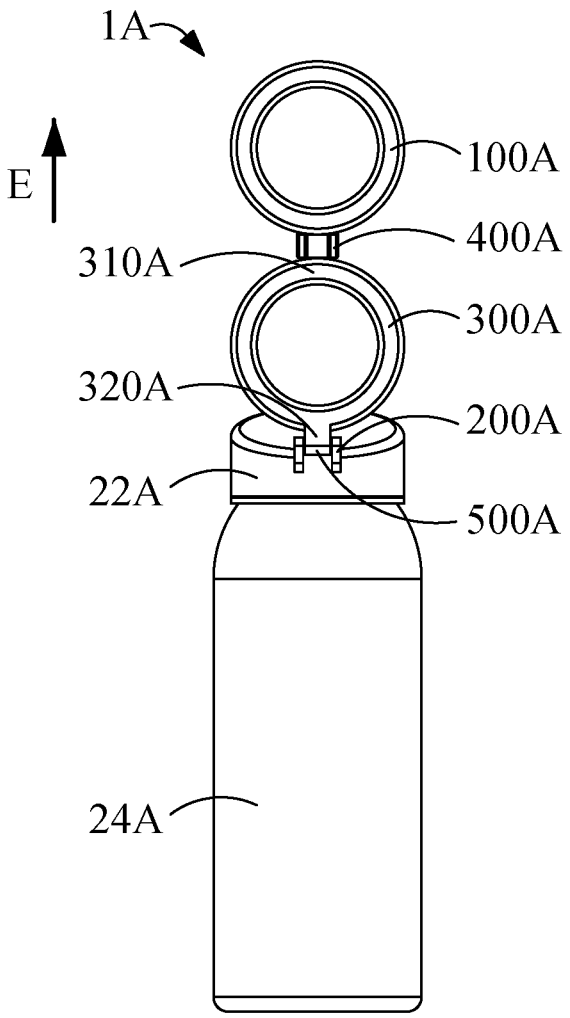
FIG. 2 is a schematic front view of the mobile device attachment and the container in FIG. 1.
Figure 3:
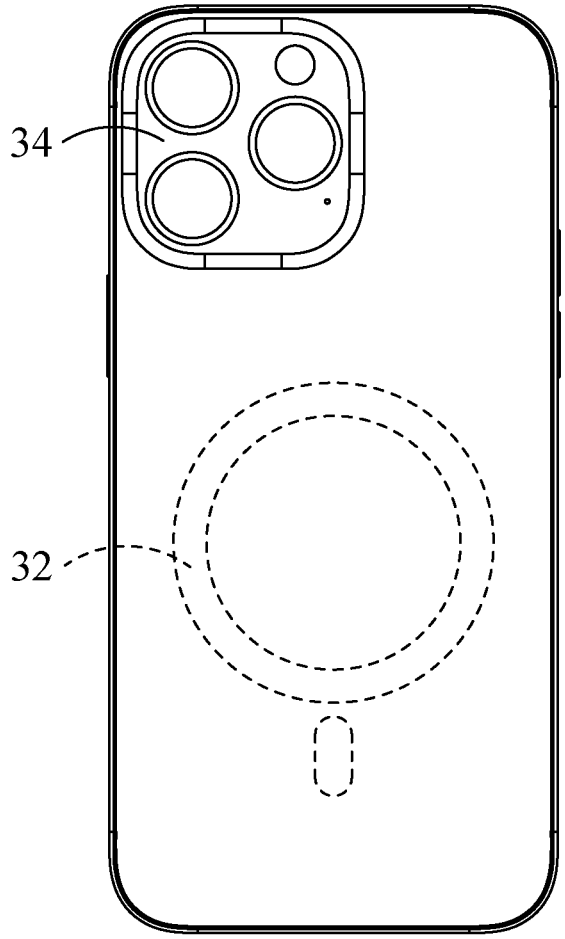
FIG. 3 is a schematic rear view of the mobile device in FIG. 1.

Referring to FIG. 2 and FIG. 3, FIG. 2 is a schematic front view of the mobile device attachment and the container in FIG. 1, and FIG. 3 is a schematic rear view of the mobile device in FIG. 1. In detail, the mobile device attachment 1A includes a magnetic connecting member 100A and a connecting member 200A, and the magnetic connecting member 100A is configured to be magnetically connected to the mobile device 3. As shown in figures, the mobile device 3 has a magnetic connecting feature 32 and an image capturing unit 34 on the back side, wherein the magnetic connecting feature 32 is a ring-shaped magnet embedded in the mobile device 3 or a protective case of the mobile device, such as MAGSAFE interface. In other embodiments, the magnetic connecting feature 32 may also be a ring magnet patch attached to the back of the mobile device 3 or the back of the protective case of the mobile device, and the magnetic connecting member 100A may correspondingly form a ring-shaped structure which is embedded with a magnet inside. The imaging capture unit 34 may include a plurality of optical lenses with photographic functions. Thus, when the magnetic connecting member 100A and the magnetic connecting feature 32 of the mobile device 3 are aligned with each other, the mobile device attachment 1A may fix the mobile device 3 at a specific position through the magnetic connecting member 100A magnetically connected to the mobile device 3. When the user no longer needs to fix the mobile device 3, the mobile device 3 can be removed from the magnetic connecting member 100A, so it is quite simple and convenient to use. It is worth mentioning that in the present embodiment, the magnetic connecting member 100A takes a ring shape as an example, but in other possible embodiments, the magnetic connecting member 100A may also be disc-shaped, C-shaped or semi-circular, and the magnetic strength may also be adjusted according to the weight of the mobile device 3 and the container 2A, as long as the function of magnetically connecting and fixing the mobile device 3 can be realized.

On the other hand, the connecting member 200A is disposed between the container 2A and the magnetic connecting member 100A, and the container 2A includes a lid 22A and a body part 24A. The lid 22A may be disposed on the body part 24A in a way that is able to be opened or closed or detachably, and one of the lid 22A and the body part 24A may be used as a mounting member for mounting the mobile device attachment 1A. In the present embodiment, taking the lid 22A acting as a mounting member for example, and the connecting member 200A is disposed on the lid 22A. Accordingly, the magnetic connecting member 100A can extend in an escaping direction E.

Further, the connecting member 200A, for example, is a hinged base, and the mobile device attachment 1A further includes an extending member 300A, a first pivot member 400A and a second pivot member 500A. The extending member 300A, for example, is a ring-shaped structure whose shape, size and thickness are substantially the same as the magnetic connecting member 100A. The extending member 300A is disposed between the magnetic connecting member 100A and the connecting member 200A, and has a first end part 310A and a second end part 320A spaced from the first end part 310A. The first pivot member 400A and the second pivot member 500A, for example, are pivot shafts. The first pivot member 400A is provided to pass through the magnetic connecting member 100A and the first end part 310A, and the second pivot member 500A is provided to pass through the connecting member 200A and the second end part 320A. By such a configuration, the magnetic connecting member 100A can be pivotally connected to the extending member 300A, and the extending member 300A is pivotally connected to the connecting member 200A through the second pivot member 500A. During operation, the extending member 300A can be flipped upwards and extended in the escaping direction E, and then the magnetic connecting member 100A connected to the first end part 310A is flipped upwards and also extended in the escaping direction E, thereby increasing a moving stroke of the magnetic connecting member 100A relative to the connecting member 200A and the lid 22A.

Figure 4:
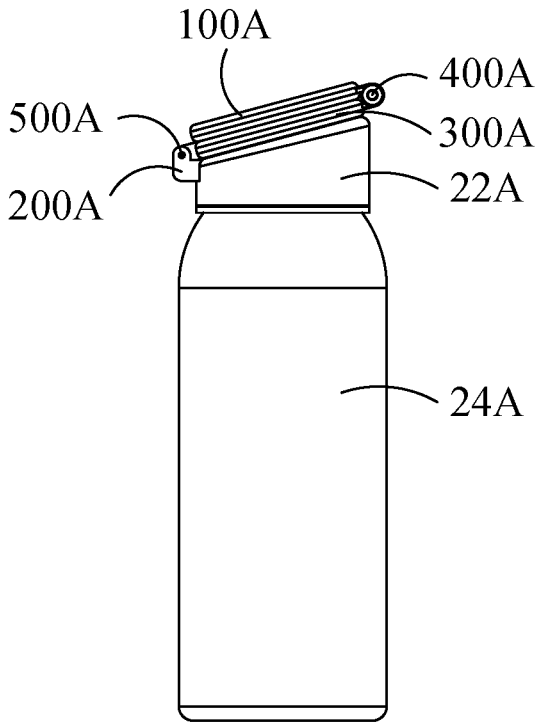
FIG. 4 shows a schematic right-hand side view when the magnetic connecting member and the extending member in FIG. 2 are in a folded position.

Referring to FIG. 4, FIG. 4 shows a schematic right-hand side view when the magnetic connecting member and the extending member in FIG. 2 are in a folded position. When the user does not have the need for magnetically connecting the mobile device 3, the extending member 300A can be folded and attached on a top surface (that is, a surface of the mounting member) of the lid 22A relative to the connecting member 200A through the second pivot member 500A, and then the magnetic connecting member 100A can be folded and fitted on a surface of the extending member 300A relative to the extending member 300A through the first pivot member 400A, so as to achieve the effect of gathering up the magnetic connecting member 100A and the extending member 300A. Since the radius of the magnetic connecting member 100A and the extending member 300A is substantially equal to the top surface of the lid 22A, when the user folds the magnetic connecting member 100A and the extending member 300A by the above method, it can not only reduce the volume occupied by the mobile device attachment 1A, but also prevent the magnetic connecting member 100A and the extending member 300A from protruding from the lid 22A in the radial direction and colliding with other external elements to be damaged, thereby improving the service life of the mobile device attachment 1A. However, in other embodiments, the radius of the magnetic connecting member 100A and the extending member 300A may also be smaller than the radius of the lid 22A, and the effect of protecting the magnetic connecting member 100A and the extending member 300A can also be achieved.

In addition, in other embodiments, the inside of the extending member 300A and the lid 22A may also be embedded with magnets or magnetic substances that can be magnetically connected by magnets. By such a configuration, when the magnetic connecting member 100A and the extending member 300A are folded, the magnetic connecting member 100A, the extending member 300A and the lid 22A can be magnetically fixed between each other, and it is not easy to separate because of external force collision. In addition, when the user wants to take the container 2A, it only needs to move the magnetic connecting member 100A and the extending member 300A superimposed with each other away from the surface of the lid 22A. That is, a finger can be used to pass through the magnetic connecting member 100A and the extending member 300A to pick the container 2A. It is worth mentioning that although the present embodiment takes the magnetic connecting member 100A, the extending member 300A and the lid 22A sequentially superimposed and folded from the outside to the inside as an example, it is not limited thereto. According to actual needs, the industry may also adjust the type or connection form of the connecting member 200A, the first pivot member 400A and the second pivot member 500A, so that the folding order is changed to that the extending member 300A, the magnetic connecting member 100A and the lid 22A are superimposed sequentially from the outside to the inside to achieve the same effect.

Figure 5:
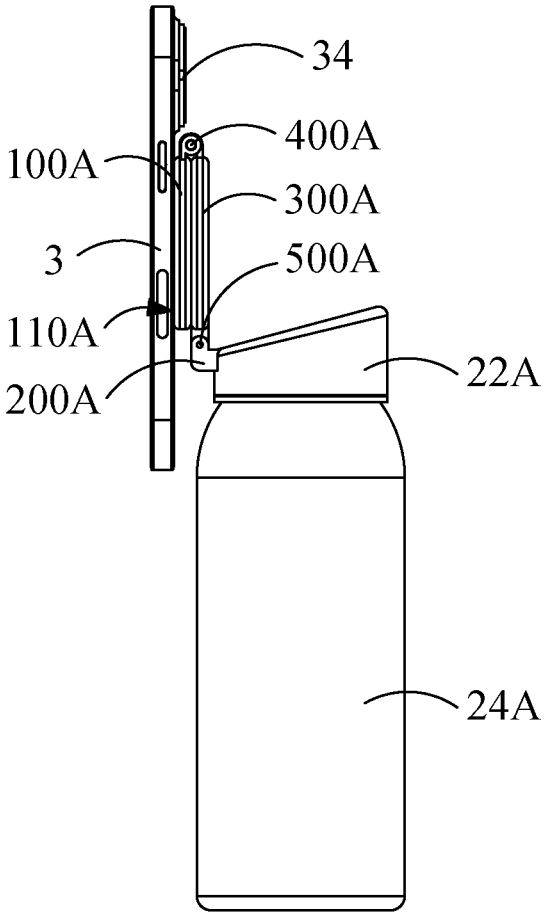
FIG. 5 shows a schematic right-hand side view when the mobile device attachment in FIG. 2 magnetically connects the mobile device in a normal mode.

Referring to FIG. 5, FIG. 5 shows a schematic right-hand side view when the mobile device attachment in FIG. 2 magnetically connects the mobile device in a normal mode. When the user wants to magnetically connect and fix the mobile device 3, the extending member 300A can be unfolded relative to the lid 22A and extended in the escaping direction E through the rotation of the second pivot member 500A, and the magnetic connecting member 100A is maintained to fit on the surface of the extending member 300A. Then the magnetic connecting feature 32 of the mobile device 3 is aligned and fitted to the magnetic connecting member 100A, and the mobile device 3 can be magnetically connected and fixed on the magnetic connecting member 100A. In some possible embodiments, the connecting member 200A and the second pivot member 500A therebetween may be disposed with a limiting structure such as a ratchet or a limiting projection, so that when the mobile device 3 is magnetically connected on the magnetic connecting member 100A, the extending member 300A can still maintain an upright posture as shown in FIG. 5 without flipping and tipping. In addition, since the extending member 300A in certain embodiments is embedded with a magnet and substantially equal in size to the magnetic connecting member 100A, the mobile device 3 may also be attached and magnetically connected to the extending member 300A from the back side of the extending member 300A, and the effect of magnetically connecting and fixing the mobile device 3 can also be achieved. It is worth noting that although FIG. 5 uses the normal mode magnetically connecting the mobile device 3 as a schematic illustration, if the shooting angle range of the image capturing unit 34 is relatively small, and the subject is not obscured by the mobile device attachment 1A and the container 2A, the user can also shoot or tape in this mode, and the same applies to other embodiments below.

Figure 6:
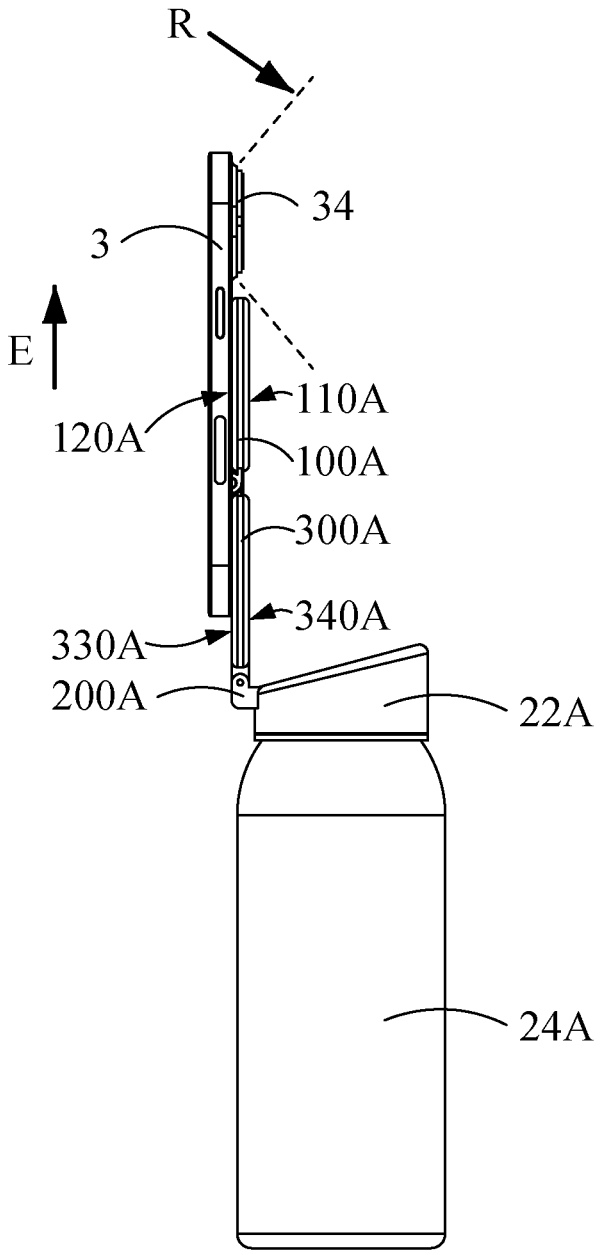
FIG. 6 shows a schematic right-hand side view when the mobile device attachment in FIG. 2 magnetically connects the mobile device in a shooting mode.

Referring to FIG. 6, FIG. 6 shows a schematic right-hand side view when the mobile device attachment in FIG. 2 magnetically connects the mobile device in a shooting mode. If the mobile device 3 is shooting in a wide-angle mode, or shooting or taping at the position of FIG. 5, it is found that the subject is obscured by the magnetic connecting member 100A, the extending member 300A or the container 2A, the magnetic connecting member 100A may be unfolded relative to the extending member 300A through the first pivot member 400A and further extended in the escaping direction E. Because the connection relationship between the magnetic connecting member 100A and the connecting member 200A and the extending member 300A increases the moving stroke relative to the container 2A, the magnetic connecting member 100A, all the connecting member 200A, the extending member 300A and the container 2A are located outside the image capturing range R corresponding to the image capturing unit 34 (e.g., 45 degrees elevation angle and 45 degree depression angle), so as to avoid the subject being obscured or a disguised restriction that the user can only use the front lens with the poor function to shoot, thereby improving the quality and convenience of the user to take photos or tape videos. Similar to the second pivot member 500A, the extending member 300A and the first pivot member 400A therebetween may also be provided with a limiting structure such as a ratchet or a limiting projection, so that when the magnetic connecting member 100A is unfolded relative to the extending member 300A and magnetically connects the mobile device 3, it is still able to maintain the upright posture shown in FIG. 6 without flipping and tipping.

It is worth mentioning that the magnetic connecting member 100A and the extending member 300A may magnetically connect to each other or the mobile device 3 by different directions. As shown in FIG. 5, when the mobile device attachment 1A and the container 2A magnetically connect the mobile device 3 in the normal mode, the mobile device 3 is attached to a first surface 110A of the magnetic connecting member 100A, which is away from the extending member 300A. As shown in FIG. 6, when the mobile device attachment 1A and the container 2A magnetically connect the mobile device 3 in the shooting mode, the mobile device 3 is attached to a surface of the magnetic connecting member 100A, which is originally fitted to the extending member 300A, that is, a second surface 120A opposite to the first surface 110A. In other words, since the two opposite surfaces of the magnetic connecting member 100A and the extending member 300A have magnetically connecting functions, the mobile device 3 may be selectively attached to the first surface 110A or the second surface 120A of the magnetic connecting member 100A, or a first surface 330A or a second surface 340A of the extending member 300A shown in FIG. 6, greatly improving the flexibility of use.

Figure 7:
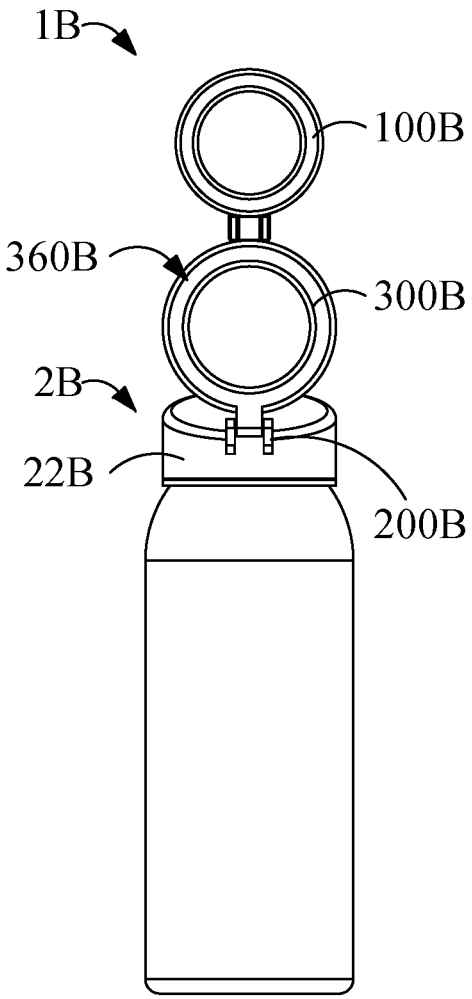
FIG. 7 is a schematic front view of the mobile device attachment and the container of another embodiment.

Referring to FIG. 7, FIG. 7 is a schematic front view of the mobile device attachment and the container of another embodiment. The mobile device attachment 1B and the container 2B of the present embodiment are roughly similar to the mobile device attachment 1A and the container 1B of the aforementioned embodiment, wherein the mobile device attachment 1B includes a magnetic connecting member 100B, a connecting member 200B and an extending member 300B. The connecting member 200B is disposed on a lid 22B of the container 2B, and the extending member 300B is disposed between the magnetic connecting member 100B and the connecting member 200B. The main difference between the two is that the magnetic connecting member 100B and the extending member 300B differ in size from each other, and the extending member 300B has an accommodating part 360B for accommodating the magnetic connecting member 100B.

In detail, when the mobile device 3 is not magnetically connected and fixed, compared with the type of magnetic connecting member 100A and the extending member 300A of the mobile device attachment 1A only attached to each other, the mobile device attachment 1B may further reduce the volume occupied by the magnetic connecting member 100B and the extending member 300B by means of accommodation. As shown in FIG. 7, the size of the magnetic connecting member 100B is smaller than that of the extending member 300B, and the extending member 300B forms an accommodating part 360B on a surface that is configured to accommodate the magnetic connecting member 100B. The accommodating part 360B, for example, is an annular groove and the size corresponds to the magnetic connecting member 100B. Thus, when the magnetic connecting member 100B and the extending member 300B are folded with each other, the accommodating part 360B can accommodate a portion or even the whole of the magnetic connecting member 100B, thereby reducing the volume occupied. It is worth noting that in some possible embodiments, the size of the magnetic connecting member 100B may also be designed to be larger than the size of the extending member 300B, and the magnetic connecting member 100B forms an accommodating part thereon, and when folding the mobile device attachment 1B, the extending member 300B is completely fastened inside through the magnetic connecting member 100B to achieve the same or even better protection effect.

Figure 8:
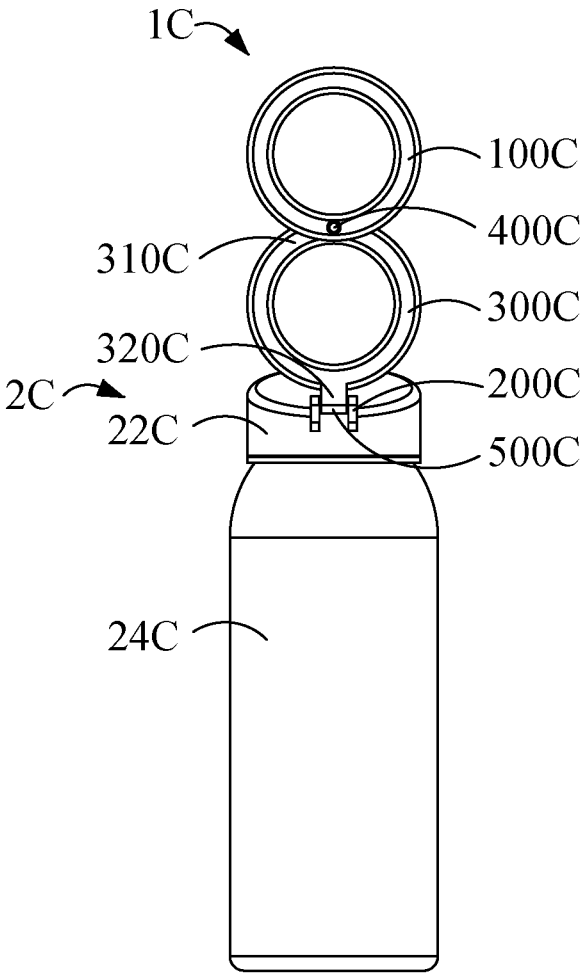
FIG. 8 is a schematic front view of the mobile device attachment and the container of another embodiment.

Referring to FIG. 8, FIG. 8 is a schematic front view of the mobile device attachment and the container of another embodiment. The mobile device attachment 1C and the container 2C of the present embodiment are roughly similar to the mobile device attachment 1A and the container 2A of the aforementioned embodiment. The container 2C includes a lid 22C and a body part 24C, and the lid 22C may be disposed on the body part 24C in a way that is able to be opened or closed or detachably. The mobile device attachment 1C includes a magnetic connecting member 100C, a connecting member 200C, an extending member 300C, a first pivot member 400C and a second pivot member 500C. The connecting member 200C is disposed on the lid 22C. The extending member 300C is disposed between the magnetic connecting member 100C and the connecting member 200C, and has a first end part 310C and a second end part 320C. The first pivot member 400C is provided to pass through the magnetic connecting member 100C and the first end part 310C. The second pivot member 500C is provided to pass through the connecting member 200C and the second end part 320C. The main difference between the two is that the rotation axis of the first pivot member 400C is perpendicular to a surface of the magnetic connecting member 100C for magnetically connecting the mobile device 3.

Figure 9:
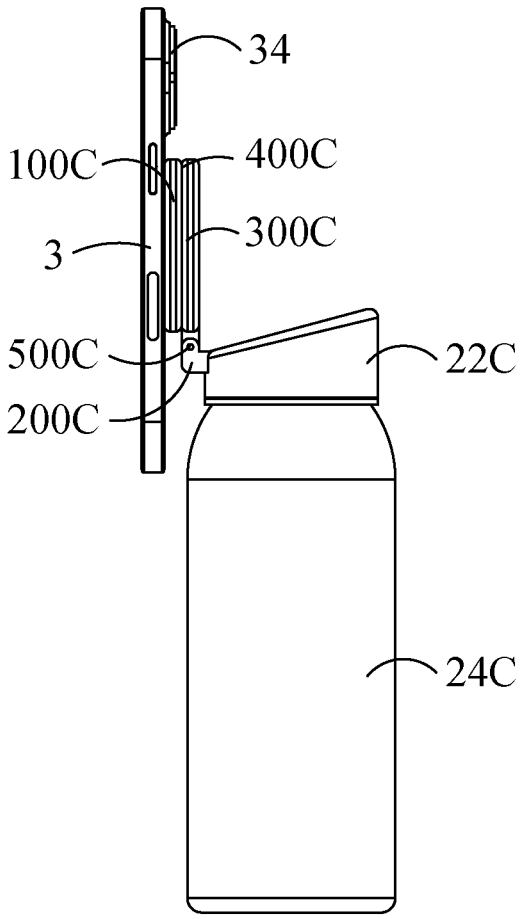
FIG. 9 shows a schematic right-hand side view when the mobile device attachment in FIG. 8 magnetically connects the mobile device in a normal mode.
Figure 10:
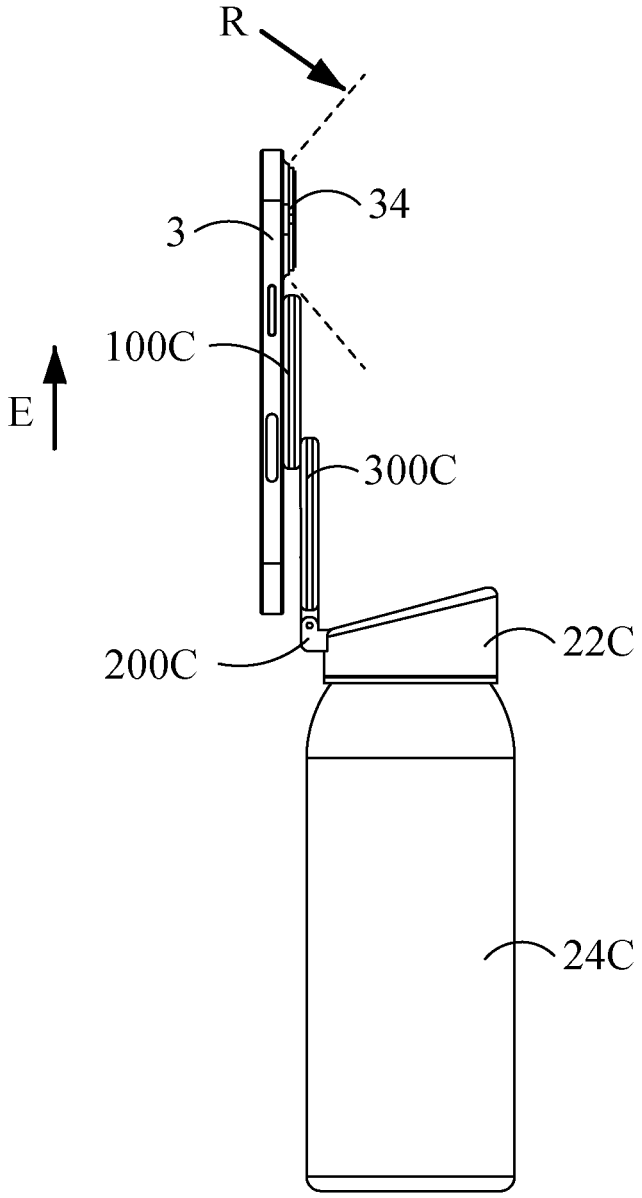
FIG. 10 shows a schematic right-hand side view when the mobile device attachment in FIG. 8 magnetically connects the mobile device in a shooting mode.

Referring to FIG. 8 to FIG. 10 together, FIG. 9 shows a schematic right-hand side view when the mobile device attachment in FIG. 8 magnetically connects the mobile device in a normal mode, and FIG. 10 shows a schematic right-hand side view when the mobile device attachment in FIG. 8 magnetically connects the mobile device in a shooting mode. In detail, in contrast to the rotation axis of the first pivot member 400A in the mobile device attachment 1A being parallel to the surface of the magnetic connecting member 100A for magnetically connecting the mobile device 3, and the rotation axis of the first pivot member 400C is perpendicular to the surface of the magnetic connecting member 100C for magnetically connecting the mobile device 3. By such a configuration, not only can the thickness of the magnetic connecting member 100C and the extending member 300C be reduced when they are folded, but when the mobile device attachment 1C switches from the normal mode shown in FIG. 9 to the shooting mode shown in FIG. 10, the magnetic connecting member 100C extends in the escaping direction E in a pivoting manner rather than a flipping manner, that is, in both the normal mode and the shooting mode, the magnetic connecting member 100C magnetically connects the mobile device 3 through the same surface. Therefore, compared with the type of the mobile device attachment 1A buried with magnet or magnetic substance and simultaneously providing the magnetic function on surfaces at both sides of the magnetic connecting member 100A, the mobile device attachment 1C only needs to configure a thin magnetic sheet or magnetic tape on a side adjacent to a magnetically connecting surface of the magnetic connecting member 100C to provide sufficient magnetically connecting strength, so as to further reduce the thickness of the magnetic connecting member 100C.

Figure 11:
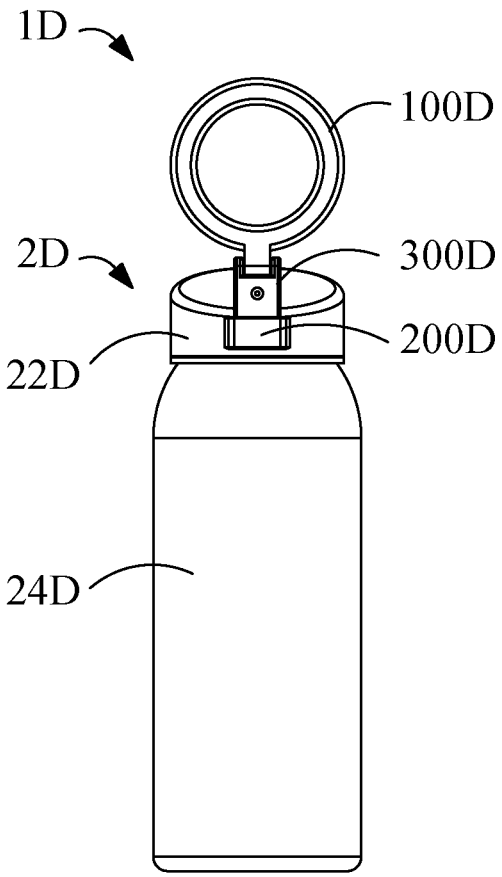
FIG. 11 is a schematic front view of the mobile device attachment and the container of another embodiment.

Referring to FIG. 11, FIG. 11 is a schematic front view of the mobile device attachment and the container of another embodiment. The mobile device attachment 1D and the container 2D of the present embodiment are roughly similar to the mobile device attachment 1A and the container 2A of the aforementioned embodiment, wherein the container 2D includes a lid 22D and a body part 24D, and the lid 22D may be disposed on the body part 24D in a way that is able to be opened or closed or detachably; the mobile device attachment 1D includes a magnetic connecting member 100D, a connecting member 200D, an extending member 300D, wherein the connecting member 200D is disposed on the lid 22D; the extending member 300D is disposed between the magnetic connecting member 100D and the connecting member 200D. The main difference between the two is that the extending member 300D is detachably connected to the connecting member 200D.

Figure 12:
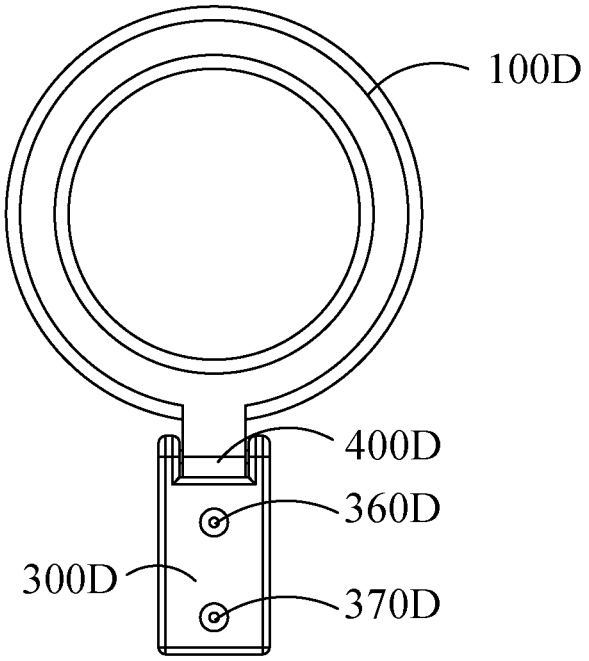
FIG. 12 is a schematic front view of the magnetic connecting member and the extending member in FIG. 11.

Referring to FIG. 11 and FIG. 12 together, FIG. 12 is a schematic front view of the magnetic connecting member and the extending member in FIG. 11. In the present embodiment, the extending member 300D, for example, is a columnar structure, and the mobile device attachment 1D further includes a first pivot member 400D, and the first pivot member 400D is disposed to pass through one end of the magnetic connecting member 100D and one of ends of the extending member 300D. Further, the extending member 300D may have a plurality of positioning parts, in the present embodiment the extending member 300D has a first positioning part 360D and a second positioning part 370D, the first positioning part 360D and the second positioning part 370D are spaced from each other, and the first positioning part 360D and the second positioning part 370D are recesses that are taken as an example. On the other hand, the connecting member 200D, for example, is a hollow structure that can accommodate the extending member 300D and forms a piercing groove, and the connecting member 200D forms a positioning feature (not shown) corresponding to the first positioning part 360D and the second positioning part 370D on an inner wall around the piercing groove, for example a projection in the present embodiment.

Accordingly, the extending member 300D may be selectively provided to pass through the connecting member 200D like a plug and socket, and the positioning feature of the connecting member 200D may be selectively embedded with one of the first positioning part 360D and the second positioning part 370D, so that the connecting member 200D and the extending member 300D are opposite fixed to each other.

Figure 13:
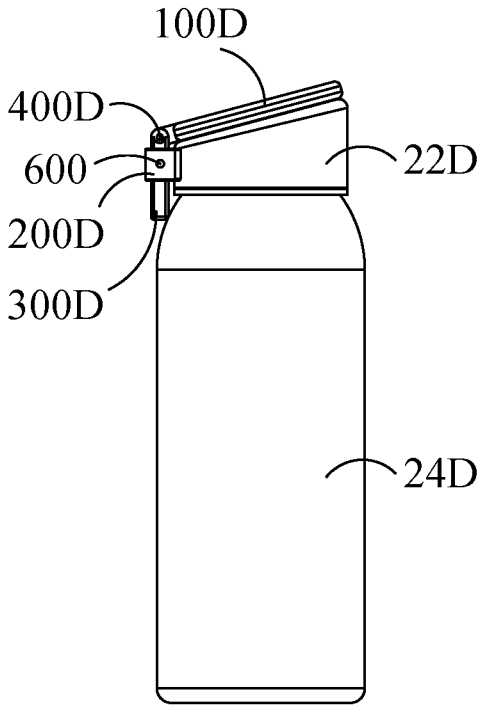
FIG. 13 shows a schematic right-hand side view when the magnetic connecting member and the extending member in FIG. 11 are in a folded position.
Figure 14:
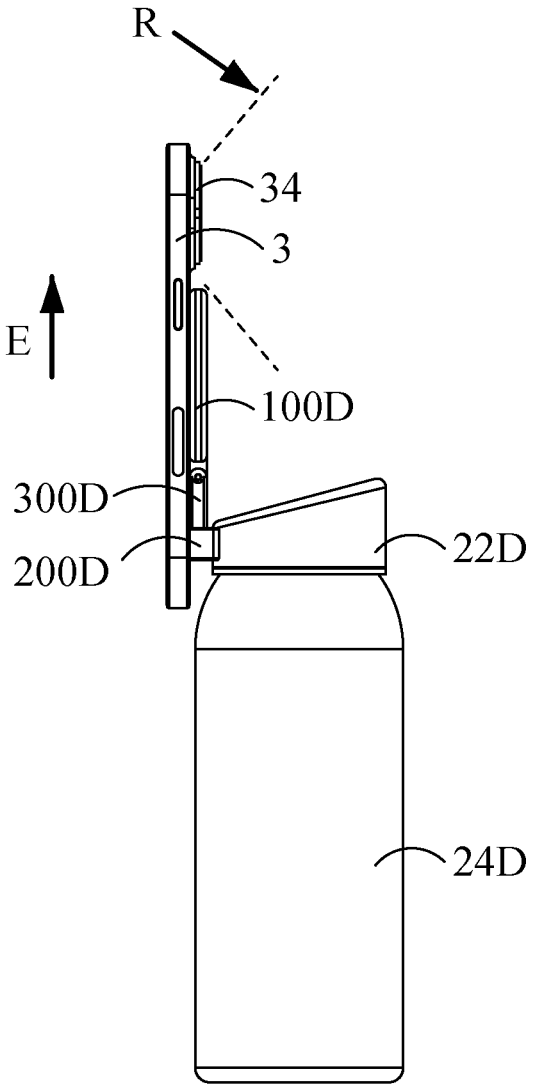
FIG. 14 shows a schematic right-hand side view when the mobile device attachment in FIG. 11 magnetically connects the mobile device in a shooting mode.

Referring to FIG. 13 and FIG. 14, FIG. 13 shows a schematic right-hand side view when the magnetic connecting member and the extending member in FIG. 11 are in a folded position, and FIG. 14 shows a schematic right-hand side view when the mobile device attachment in FIG. 11 magnetically connects the mobile device in a shooting mode. When the user does not have the need for magnetically connecting the mobile device 3, the extending member 300D can be inserted into the piercing groove of the connecting member 200D, and the positioning feature is embedded with the positioning part closer to the magnetic connecting member 100D, that is, the first positioning part 360D, the magnetic connecting member 100D and the extending member 300D are located at a relatively low place of the lid 22D at this time. Preferably, a distance between the first positioning part 360D and the first pivot member 400D may be designed so that when the positioning feature and the first positioning part 360D are embedded with each other, the magnetic connecting member 100D may be completely fitted to the surface of the lid 22D through the pivot of the first pivot member 400D, thereby improving the consistency of the appearance of the mobile device attachment 1D and the container 2D.

When the user wants to magnetically connect and fix the mobile device 3, the positioning feature can be embedded to the positioning part farther away from the magnetic connecting member 100D, that is, the second positioning part 370D, the magnetic connecting member 100D and the extending member 300D are located at a relatively high place of the lid 22D at this time, and the magnetic connecting member 100D can be flipped up through the first pivot member 400D to extend in the escaping direction E, forming a state as shown in FIG. 14. At this time, the user then magnetically connects the mobile device 3 on the magnetic connecting member 100D, because the magnetic connecting member 100D increases the moving stroke through the spacing between the extending member 300D in the first positioning part 360D and the second positioning part 370D, the magnetic connecting member 100D, the connecting member 200D, the extending member 300D and the container 2D are located outside the image capturing range R corresponding to the image capturing unit 34, thereby improving the quality and convenience of taking photos or taping videos.

It is worth mentioning that although the present embodiment uses the extending member 300D providing to pass through the connecting member 200D as a connection method between the two detachable structures, the present disclosure is not limited thereto, in other possible embodiments, the connecting member 200D may also be designed as a columnar structure extending in the escaping direction E, and the extending member 300D is designed to correspond to a hollow structure of the connecting member. Thus, the user may sleeve the extending member 300D on the connecting member 200D to make the two connect to each other, and adjust the distance between the magnetic connecting member 100D and the extending member 300D relative to the lid 22D through the embedding position of the extending member 300D and the connecting member 200D, so as to achieve the same effect.

Returning to FIG. 13 again, in some possible embodiments, the mobile device attachment 1D may further include a positioning member 600, wherein the positioning member 600, for example, is a positioning pin, and the extending member 300D may achieve the positioning effect through the positioning member 600, the positioning feature and a single positioning part. Specifically, the positioning part of the extending member 300D may be a guide groove extending in the escaping direction E, and the positioning feature of the connecting member 200D is a projection slidably provided in the guide groove, and the relative position of the connecting member 200D and the extending member 300D can be adjusted by the sliding relationship between the positioning part and the positioning feature. When the user slides the extending member 300D to a specific position, the positioning member 600 can be simultaneously pierced to the connecting member 200D and the extending member 300D, so that the extending member 300D and the connecting member 200D are relatively fixed. By such a configuration, the height of the magnetic connecting member 100D and the extending member 300D relative to the container 2D will not be limited by the first positioning part 360D and the second positioning part 370D, but can be any position on the guide groove, thus further improving the flexibility of use of the mobile device attachment 1D.

Figure 15:
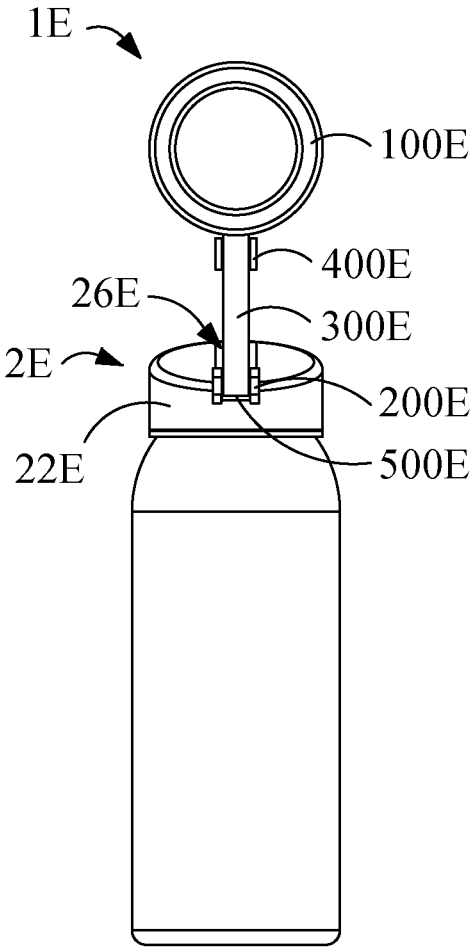
FIG. 15 is a schematic front view of the mobile device attachment and the container of another embodiment.

Referring to FIG. 15, FIG. 15 is a schematic front view of the mobile device attachment and the container of another embodiment. The mobile device attachment 1E and the container 2E of the present embodiment are roughly similar to the mobile device attachment 1B and the container 2B of the aforementioned embodiment, wherein the mobile device attachment 1E includes a magnetic connecting member 100E, a connecting member 200E, an extending member 300E, a first pivot member 400E and a second pivot member 500E, the connecting member 200C is disposed on a lid 22E of the container 2E; the extending member 300E is disposed between the magnetic connecting member 100E and the connecting member 200E; the first pivot member 400E is provided to pass through the magnetic connecting member 100E and one end of the extending member 300E, and the second pivot member 500E is provided to pass through the connecting member 200E and another end of the extending member 300E. The main difference between the two is that the extending member 300E is a plate-like structure, and the lid 22E as a mounting member forms a groove 26E thereon.

In detail, compared with the mobile device attachment 1B reducing the volume occupied through the magnetic connecting member 100B and the extending member 300B accommodated to each other, the container 2E forms the groove 26E on the lid 22E, when the magnetic connecting member 100E and the extending member 300E are folded relative to the lid 22E, the groove 26E can accommodate a portion or even the whole of the extending member 300E, thereby reducing the protruding part of the magnetic connecting member 100E and the extending member 300E relative to the lid 22E, and avoiding damage caused by collisions with other external elements.

It is worth mentioning that although the extending member 300E as a plate-like structure is taken for example in the present embodiment, the present disclosure is not limited thereto, in some possible embodiments, the extending member 300E may also form a ring shape like the extending member 300B, or even combine the functions of the extending member 300B and the extending member 300E, when the lid 22E accommodates the extending member 300E through the groove 26E, the extending member 300E also accommodates the magnetic connecting member 100E through an accommodating part formed on the surface, further reducing the exposed volume. In addition, if the folding method of the magnetic connecting member 100E and the extending member 300E is changed to that the extending member 300E, the magnetic connecting member 100E and the lid 22E are superimposed sequentially from the outside to the inside, the groove 26E may also be changed to selectively accommodate at least a portion of the magnetic connecting member 100E, the present disclosure is not limited in this regard.

Figure 16:
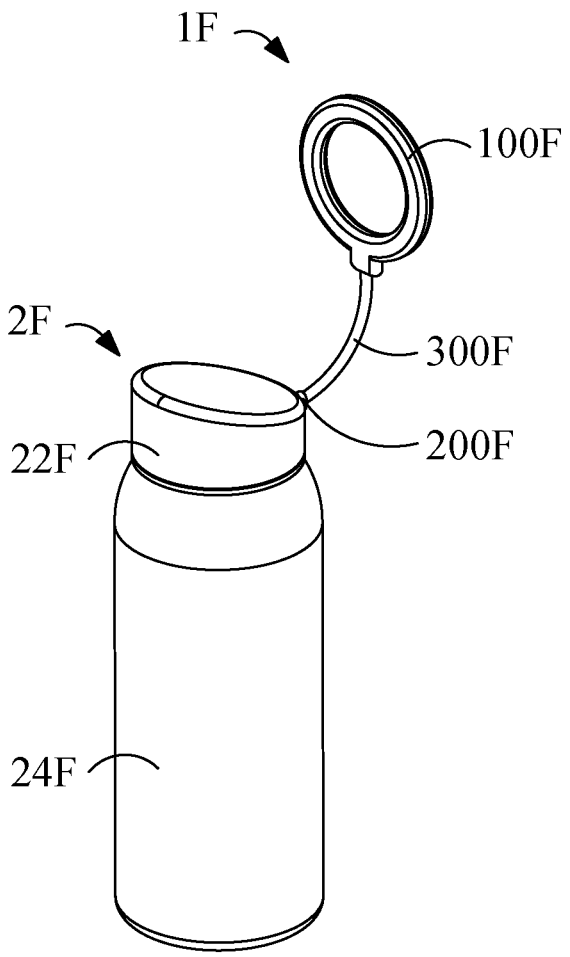
FIG. 16 is a schematic perspective view of the mobile device attachment and the container of another embodiment.

Referring to FIG. 16, FIG. 16 is a schematic perspective view of the mobile device attachment and the container of another embodiment. The container 2F of the present embodiment includes a lid 22F and a body part 24F, and the lid 22F may be disposed on the body part 24F in a way that is able to be opened or closed or detachably; the mobile device attachment 1F includes a magnetic connecting member 100F, a connecting member 200F and an extending member 300F, wherein the connecting member 200F is disposed on the lid 22F, and the extending member 300F is disposed between the magnetic connecting member 100F and the connecting member 200F. The main difference from the aforementioned mobile device attachment 1A and container 2A is that the extending member 300F is flexible.

In detail, the extending member 300F, for example, is a metallic hose that is both rigid and flexible, one end of the metallic hose is fixed on the magnetic connecting member 100F, and another end of the metallic hose is fixed on the connecting member 200F. By such a configuration, when the user needs to tape or shoot in a wide-angle mode, the position of the extending member 300F can be changed (e.g., straighten up), so that the magnetic connecting member 100F, the connecting member 200F, the extending member 300F and the container 2F are located outside the image capturing range R of the mobile device 3. By such a configuration, the extending member 300F can guide the magnetic connecting member 100F to bend in various possible directions, thereby achieving a variety of different shooting positions and angles. In addition, in other embodiments, the inside of the extending member 300F may be provided with a metallic wire in a piercing way, and the magnetic connecting member 100F may be provided with a charging coil electrically connected to the wire, and the lid 22F is provided with a battery electrically connected to the wire, thereby wirelessly charging the mobile device 3 while the magnetic connecting member 100F magnetically connecting the mobile device 3.

Figure 17:
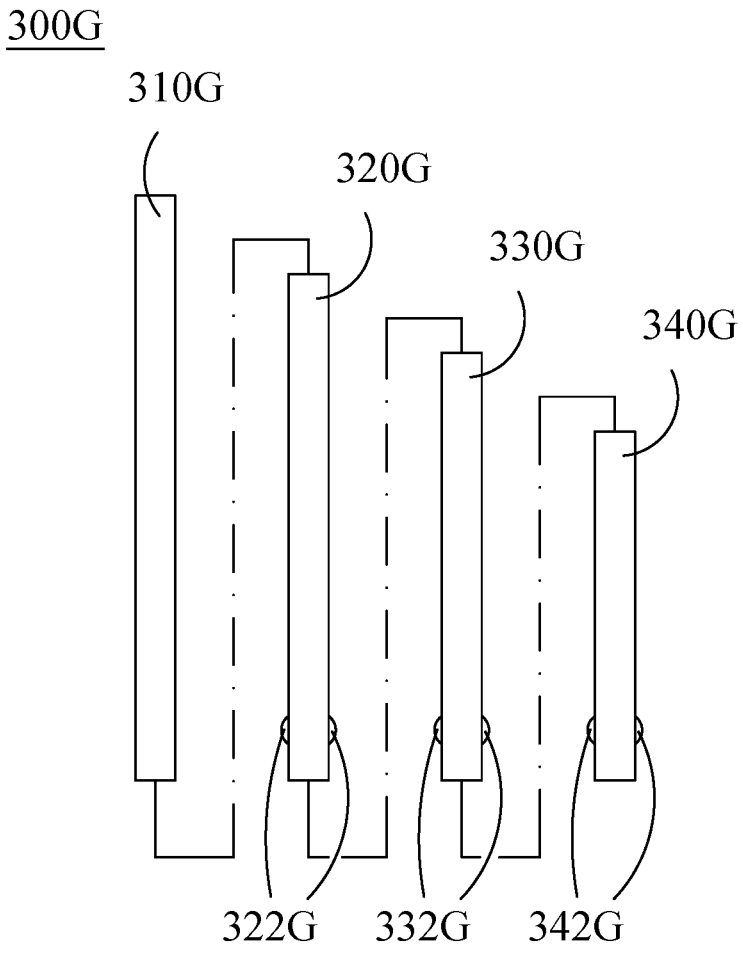
FIG. 17 is a schematic exploded view of elements of the extending member of the mobile device attachment of another embodiment.

Referring to FIG. 17, FIG. 17 is a schematic exploded view of elements of the extending member of the mobile device attachment of another embodiment. The extending member 300G of the present embodiment is roughly similar to the extending member 300F of the aforementioned embodiment. The main difference between the two is that the extending member 300G includes a plurality of pipe parts, and these pipe parts are sleeved with each other.

As shown in the figure, the extending member 300G may include a plurality of metallic hard pipe parts. Specifically, the extending member 300G includes a first pipe part 310G, a second pipe part 320G, a third pipe part 330G and a fourth pipe part 340G, wherein pipe diameters of the first pipe part 310G, the second pipe part 320G, the third pipe part 330G and the fourth pipe part 340G decrease sequentially, the second pipe part 320G is placed in the first pipe part 310G, the third pipe part 330G is placed in the second pipe part 320G, and the fourth pipe part 340G is placed in the third pipe part 330G. Further, one end of the second pipe part 320G, one end of the third pipe part 330G and one end of the fourth pipe part 340G are respectively formed with a stopping part 322G, a stopping part 332G and a stopping part 342G, wherein the stopping part 322G, the stopping part 332G and the stopping part 342G are metallic projections embedded with springs inside, and side walls of another end of the first pipe part 310G, another end of the second pipe part 320G and another end of the third pipe part 330G respectively form a through hole corresponding to each stopping part. Further, the magnetic connecting member is fixed on or pivoted to one end of the fourth pipe part 340G away from the stopping part 342G, and the bottom of the first pipe part 310G is fixed on or pivoted to the connecting member. By such a configuration, when the user wants to tape or shoot in a wide-angle mode, the fourth pipe part 340G, the third pipe part 330G and the second pipe part 320G can be selectively pulled out relative to an upper end of the first pipe part 310G according to the needs, and the relative position of each pipe part can be fixed through the stopping relation between each stopping part and through hole, so as to avoid being obscured by the container or other elements during shooting.

Figure 18:
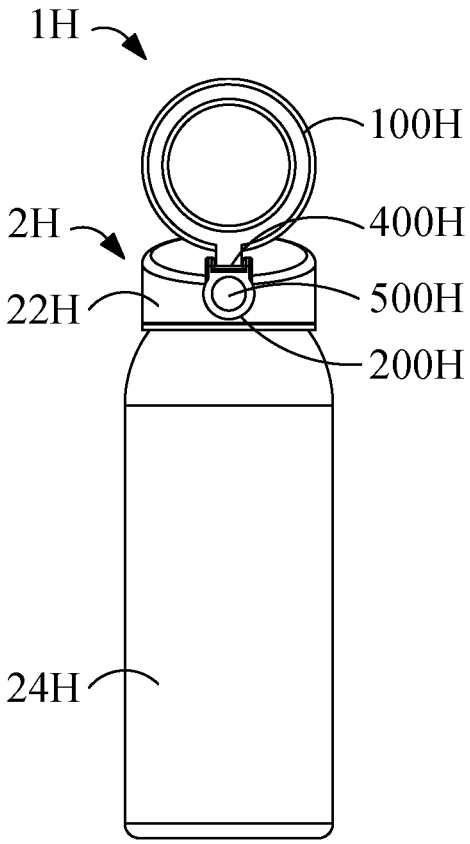
FIG. 18 is a schematic front view of the mobile device attachment and the container of another embodiment.

Referring to FIG. 18, FIG. 18 is a schematic front view of the mobile device attachment and the container of another embodiment. The container 2H of the present embodiment includes a lid 22H and a body part 24H, and the lid 22H may be disposed on the body part 24H in a way that is able to be opened or closed or detachably; the mobile device attachment 1H includes a magnetic connecting member 100H, a connecting member 200H, a first pivot member 400H and a second pivot member 500H, and the connecting member 200H is disposed on the lid 22H. The main difference with the aforementioned mobile device attachment 1A and container 2A is that: the mobile device attachment 1H fails to have an extending member, the first pivot member 400H is disposed between the magnetic connecting member 100H and the connecting member 200H, and the second pivot member 500H is disposed between the connecting part 200H and the lid 22H.

Figure 19:
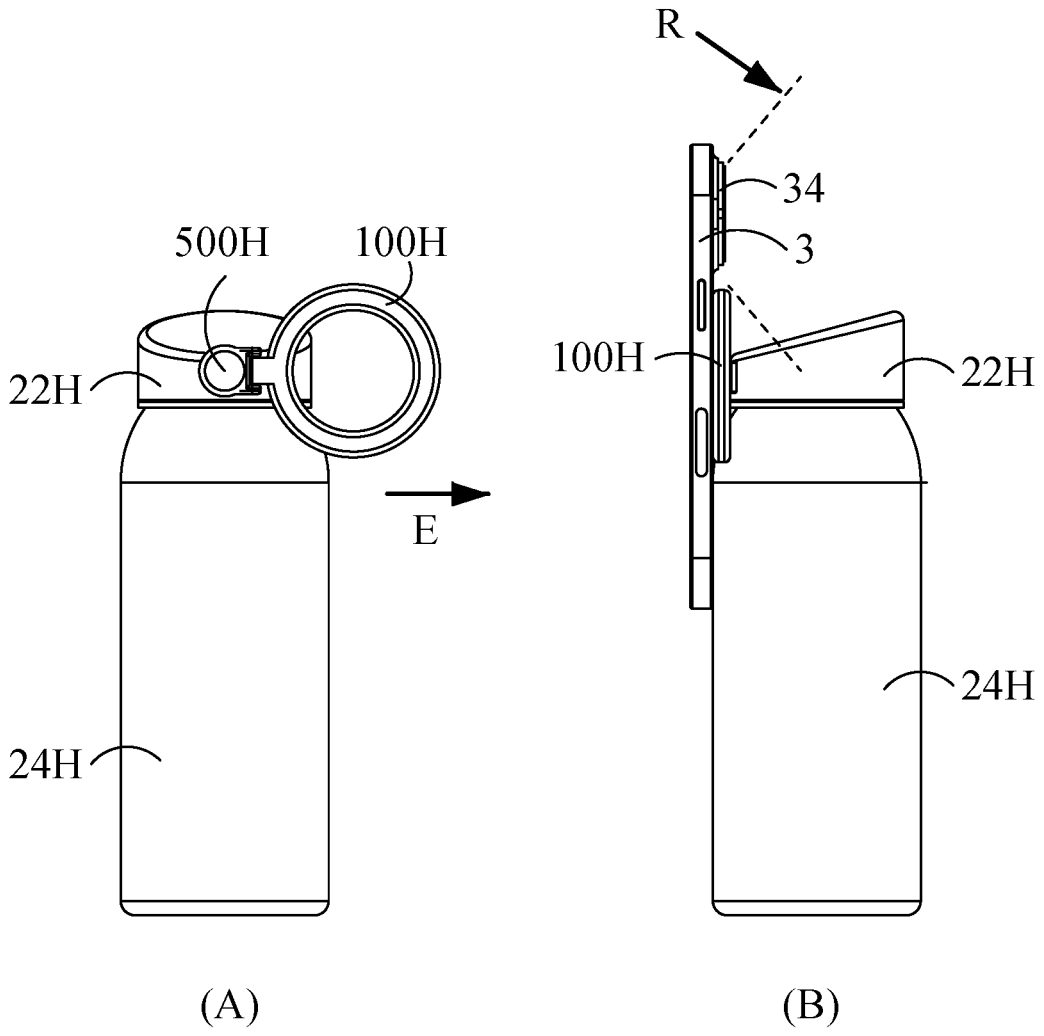
FIG. 19 shows (A) a schematic front view and (B) a schematic right-hand side view when the mobile device attachment in FIG. 18 magnetically connects the mobile device in a shooting mode.
Figure 20:
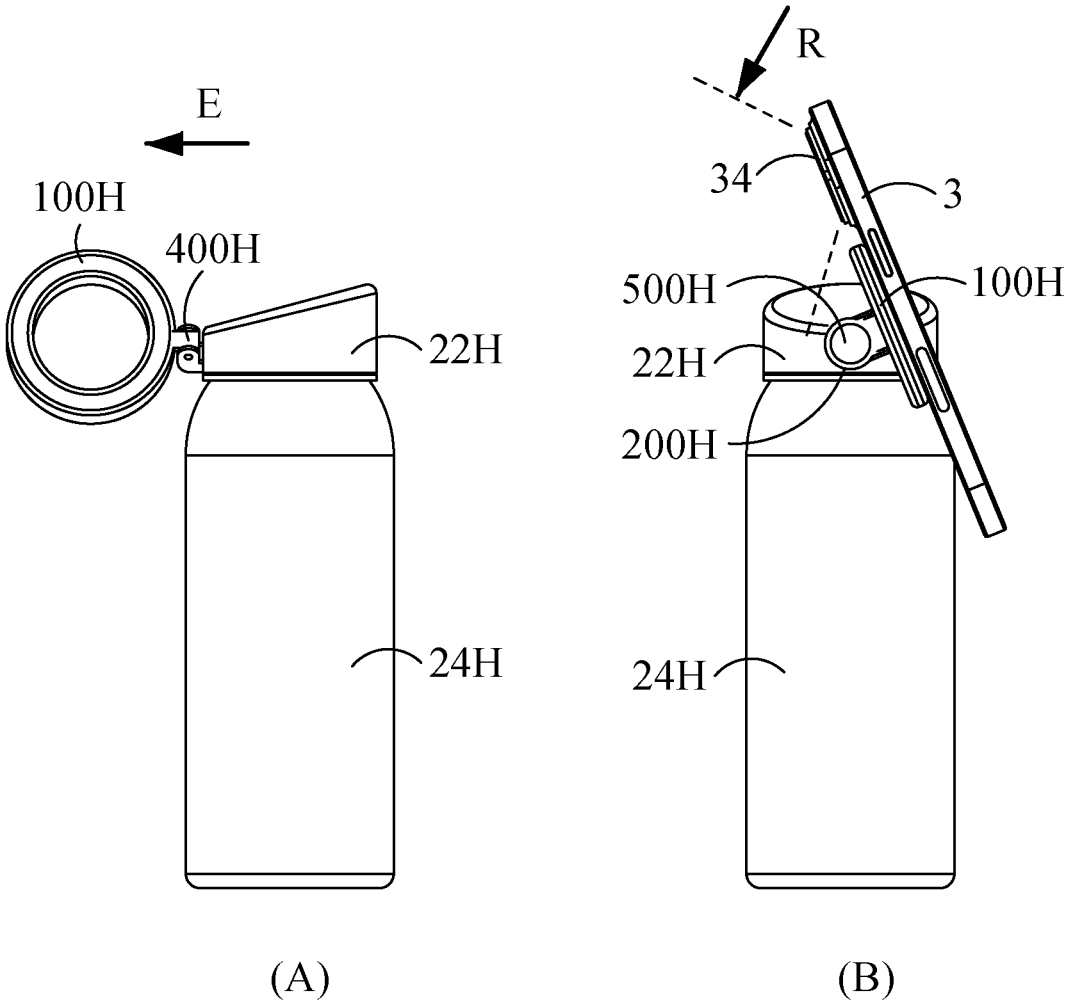
FIG. 20 shows (A) a schematic right-hand side view and (B) a schematic front view when the mobile device attachment in FIG. 18 magnetically connects the mobile device in another shooting mode.

Referring to FIGS. 18 to 20 together, FIG. 19 shows (A) a schematic front view and (B) a schematic right-hand side view when the mobile device attachment in FIG. 18 magnetically connects the mobile device in a shooting mode, and FIG. 20 shows (A) a schematic right-hand side view and (B) a schematic front view when the mobile device attachment in FIG. 18 magnetically connects the mobile device in another shooting mode. Compared with the mobile device attachment 1A increasing the moving stroke of the magnetic connecting member 100A relative to the container 2A through the extending member 300A, the mobile device attachment 1H may make the magnetic connecting member 100H, the connecting member 200H and the container 2H located outside the image capturing range R of the mobile device 3 respectively by the pivot of the first pivot member 400H and the second pivot member 500H. Specifically, the connecting member 200H, for example, is a rotating shaft base, and the second pivot member 500H, for example, is a rotating shaft inserted on the lid 22H through the connecting member 200H, and the magnetic connecting member 100H can be pivotally connected to the connecting member 200H through the first pivot member 400H. Thus, as shown in FIG. 19, the user may make the magnetic connecting member 100H extend in the escaping direction E (i.e., the right in FIG. 19) through the pivot of the second pivot member 500H, so that when the image capturing unit 34 shoots, both the lid 22H and the body part 24H are located on the left side of the image capturing range R without obscuring the subject. Alternatively, as shown in FIG. 20, the user may make a normal direction of a surface of the magnetic connecting member 100H adsorbing the mobile device 3 skewed relative to the container 2H through the pivot of the first pivot member 400H, so that when the image capturing unit 34 shoots, both the lid 22H and the body part 24H are located at the right side of the image capturing range R without obscuring the subject. In other words, the magnetic connecting member 100H may be rotated or flipped relative to the container 2H through the pivot of the first pivot member 400H or the second pivot member 500H, respectively, so that the container 2H is away from the image capturing range R to achieve the effect of improving the shooting quality, in the present embodiment, the axial direction of the first pivot member 400H is perpendicular to the axial direction of the second pivot member 500H.

Figure 21:
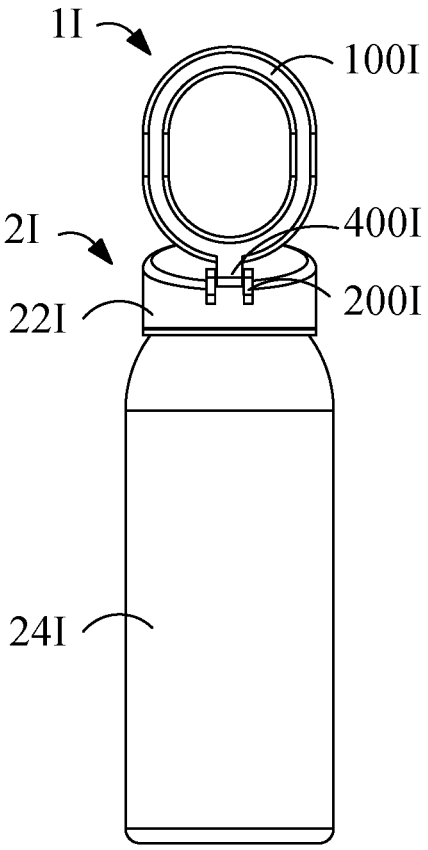
FIG. 21 is a schematic front view of the mobile device attachment and the container of another embodiment.

Referring to FIG. 21, FIG. 21 is a schematic front view of the mobile device attachment and the container of another embodiment. The container 2I of the present embodiment includes a lid 22I and a body part 24I, and the lid 22I may be disposed on the body part 24I in a way that is able to be opened or closed or detachably; and the mobile device attachment 1I includes a magnetic connecting member 100I, a connecting member 200I and a first pivot member 400I, wherein the connecting member 200I is disposed on the lid 22I, and the magnetic connecting member 100I can be pivotally connected to the connecting member 200I through the first pivot member 400I. The main difference with the aforementioned mobile device attachment 1H and container 2H is that: the mobile device attachment 1I fails to have the second pivot member, and the magnetic connecting member 100I includes an extending part extending in the escaping direction.

Figure 22:
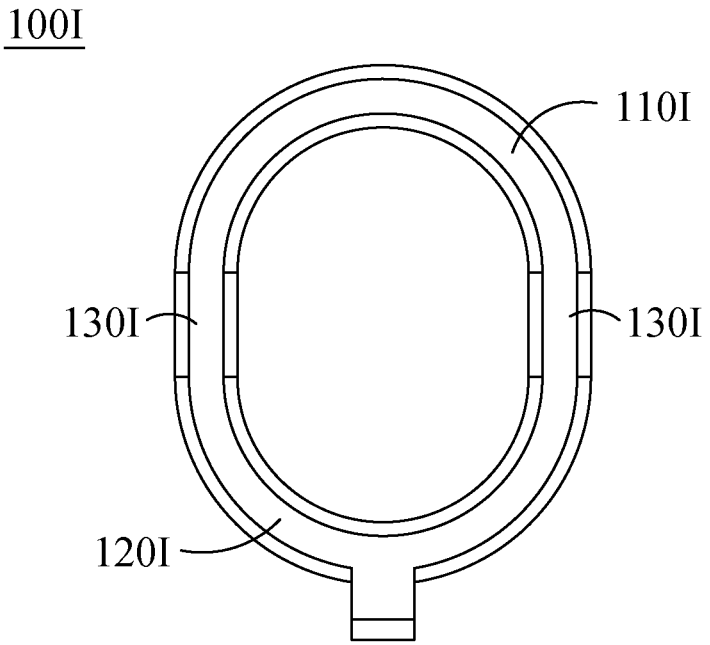
FIG. 22 is a schematic front view of the magnetic connecting member in FIG. 21.

Referring to FIG. 22, FIG. 22 is a schematic front view of the magnetic connecting member in FIG. 21. As shown in the figure, compared with the standard ring-shaped magnetic connecting members 100A to 100H, the magnetic connecting member 100I includes an extending part 130I, and the extending part 130I extends in the escaping direction. Specifically, the magnetic connecting member 100I further includes a first magnetic connecting part 110I and a second magnetic connecting part 120I, wherein the shape and size of the first magnetic connecting part 110I correspond to a part of the magnetic connecting feature 32 of the mobile device 3, the shape and size of the second magnetic connecting part 120I correspond to another part of the magnetic connecting feature 32, in the present embodiment, the parts of the first magnetic connecting part 110I and the second magnetic connecting part 120I corresponding to the magnetic connecting feature 32 are semicircular, and the extending part 130I is a columnar structure disposed between the first magnetic connecting part 110I and the second magnetic connecting part 120I. By such a configuration, the mobile device 3 may selectively magnetically connect the first magnetic connecting part 110I and the second magnetic connecting part 120I through the magnetic connecting feature 32, thereby adjusting the position relative to the magnetic connecting member 100I.

Figure 23:
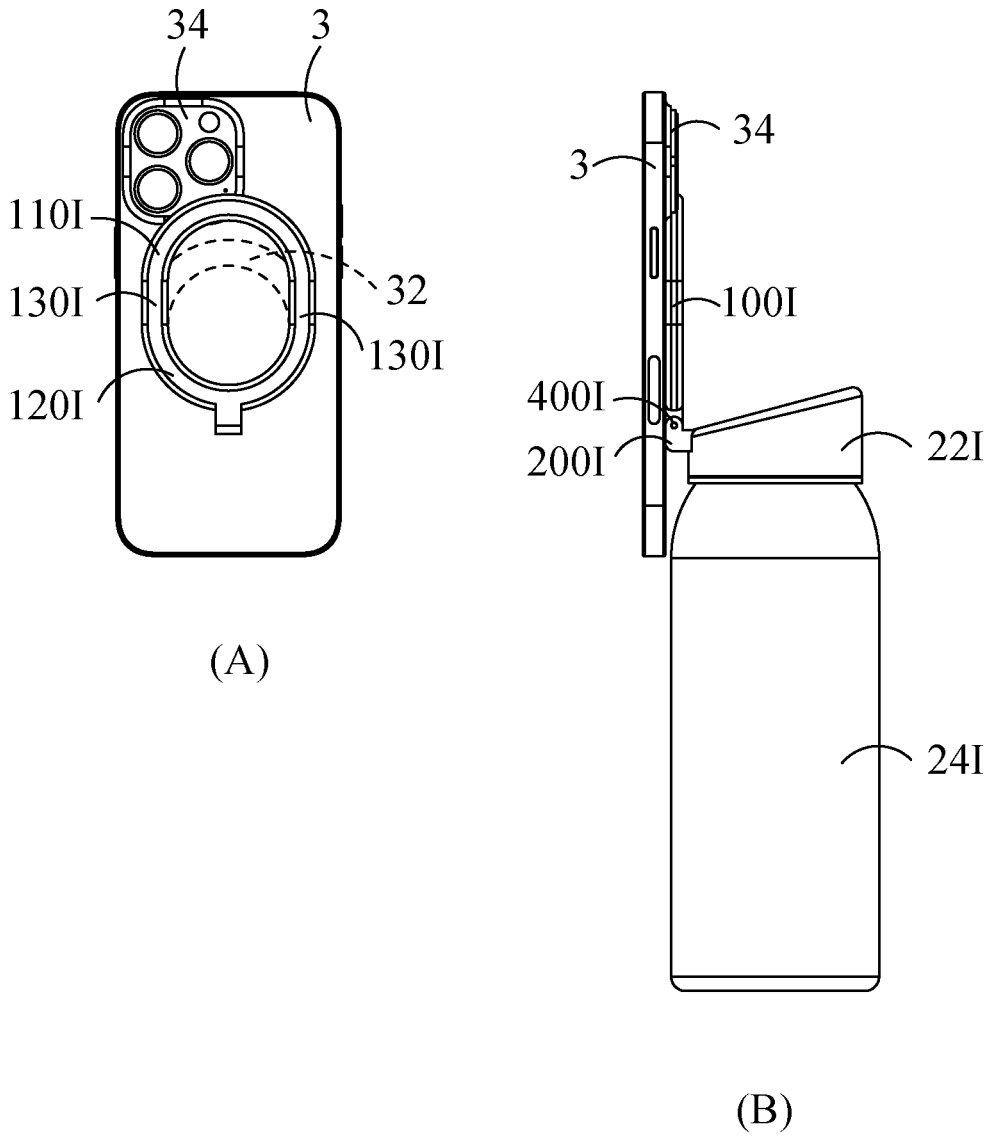
FIG. 23 shows (A) a schematic rear view and (B) a schematic right-hand side view when the mobile device attachment in FIG. 21 magnetically connects the mobile device in a normal mode.
Figure 24:
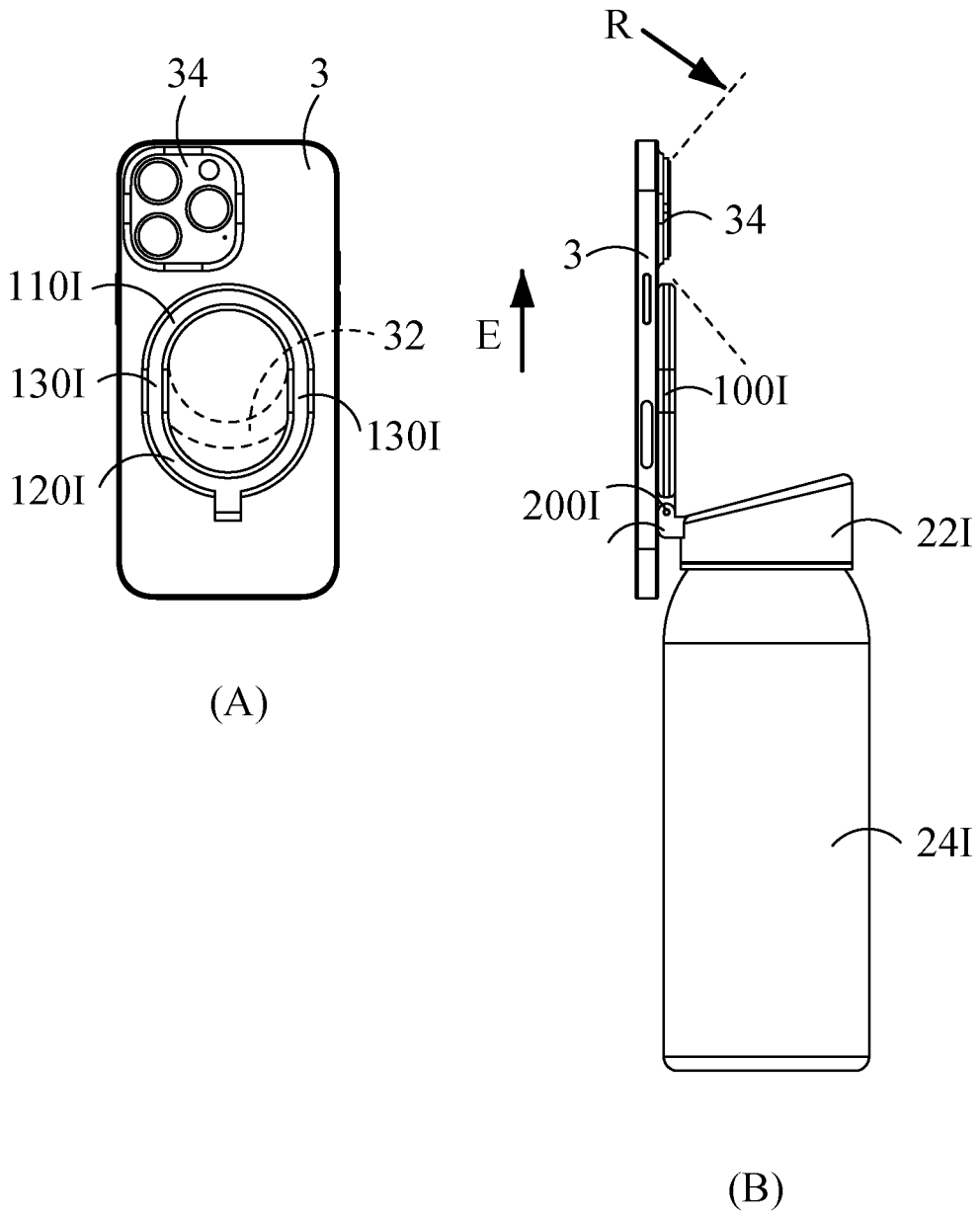
FIG. 24 shows (A) a schematic rear view and (B) a schematic right-hand side view when the mobile device attachment in FIG. 21 magnetically connects the mobile device in a shooting mode.

Referring to FIGS. 23 and 24, FIG. 23 shows (A) a schematic rear view and (B) a schematic right-hand side view when the mobile device attachment in FIG. 21 magnetically connects the mobile device in a normal mode, and FIG. 24 shows (A) a schematic rear view and (B) a schematic right-hand side view when the mobile device attachment in FIG. 21 magnetically connects the mobile device in a shooting mode. When the user wants to magnetically connect and fix the mobile device 3, the first pivot member 400I may be pivoted, so that the magnetic connecting member 100I is unfolded upward relative to the connecting member 200I and the lid 22I, and the second magnetic connecting part 120I and a portion of the magnetic connecting feature 32 (e.g., the lower half) are aligned with each other. In other words, the magnetic connecting member 100I magnetically connects and fixes the mobile device 3 by the second magnetic connecting part 120I, and the mobile device 3 is located at a relatively low place of the container 2I.

If the user finds that the subject is obscured when shooting or taping, or it needs to further use the wide-angle mode for shooting, the mobile device 3 may be moved upward (i.e., escaping direction E) relative to the magnetic connecting member 100I as shown in FIG. 24, and the first magnetic connecting part 110I and a portion of the magnetic connecting feature 32 (e.g., the upper half) are aligned with each other, that is, the magnetic connecting member 100I magnetically connects and fixes the mobile device 3 by the first magnetic connecting part 110I, and the mobile device 3 is located at a relatively high place of the container 2I. In other words, by configuring the extending part 130I, the spacing between the first magnetic connecting part 110I and the second magnetic connecting part 120I is increased, and the mobile device 3 may selectively magnetically connect to the first magnetic connecting part 110I or the second magnetic connecting part 120I through the magnetic connecting feature 32, so that all the magnetic connecting member 100I, the connecting member 200I and the container 2I are located outside the image capturing range R, thereby improving the quality of taking photos or taping videos.

Figure 25:
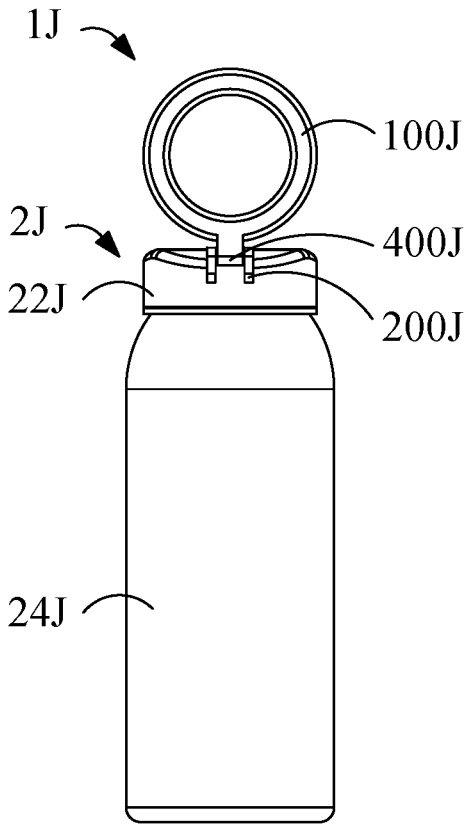
FIG. 25 is a schematic front view of the mobile device attachment and the container of another embodiment.

Referring to FIG. 25, FIG. 25 is a schematic front view of the mobile device attachment and the container of another embodiment. The mobile device attachment 1J and the container 2J of the present embodiment are roughly similar to the mobile device attachment 1I and the container 2I of the aforementioned embodiment, wherein the container 2J includes a lid 22J and a body part 24J, and the lid 22J may be disposed on the body part 24J in a way that is able to be opened or closed or detachably; and the mobile device attachment 1J includes a magnetic connecting member 100J, a connecting member 200J and a first pivot member 400J, wherein the connecting member 200J is disposed on the lid 22J, and the magnetic connecting member 100J can be pivotally connected to the connecting member 200J through the first pivot member 400J. The main difference between the two is that: the magnetic connecting member 100J is ring-shaped, and a top of the mounting member (i.e., the lid 22J) in the escaping direction is located outside the image capturing range.

Figure 26:
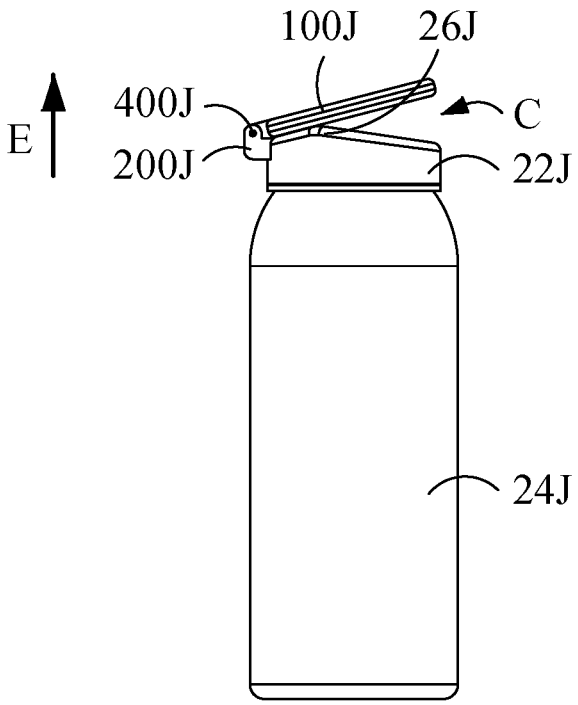
FIG. 26 is a schematic right-side view when the magnetic connecting member in FIG. 25 is in the folded position.

Referring to FIG. 26, FIG. 26 is a schematic right-side view when the magnetic connecting member in FIG. 25 is in the folded position. In detail, the lid 22J has a top 26J in the escaping direction E, in other words, the top 26J is the most protruding part of the lid 22J in the escaping direction E. In addition, unlike the monotonically upwardly inclined lid 22I in FIG. 23 (that is, viewing from the side, the slope of the profile of the lid 22I from the bottom to the top is always greater than or equal to zero), the lid 22J as shown in FIG. 26 inclines downwards from the top 26J located at the center (or near the center) to the periphery respectively, that is, the height of the upper surface of the lid 22J viewing from the side shows a change of first high and then low. Thus, when the magnetic connecting member 100J is folded relative to the lid 22J through the pivot of the first pivot member 400J, a clearance C can be formed between the magnetic connecting member 100J and a lower end of the upper surface of the lid 22J; when the user wants to unfold the magnetic connecting member 100J, it can be lifted through the clearance C from a lower part of the magnetic connecting member 100J, thereby improving the convenience of use.

Figure 27:
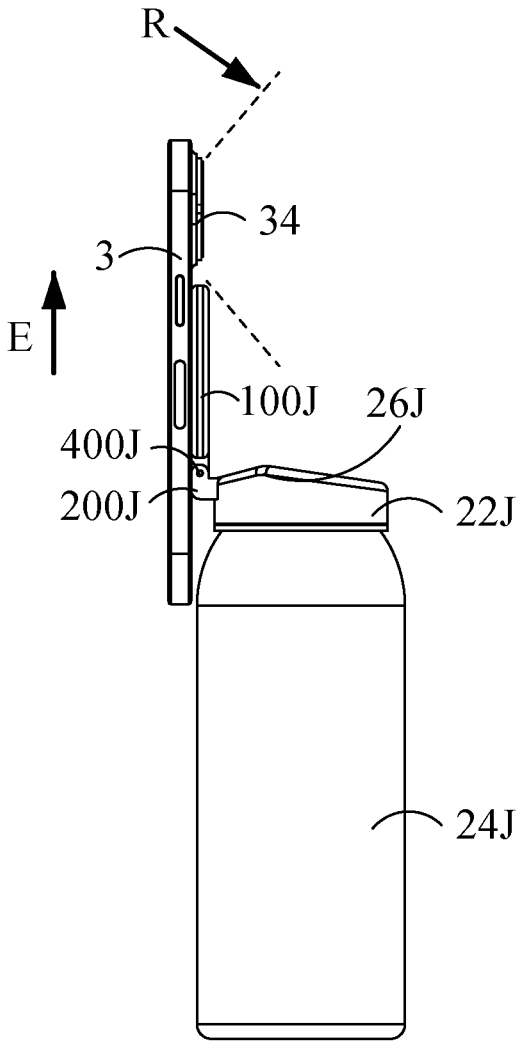
FIG. 27 is a schematic right-hand side view when the mobile device attachment in FIG. 25 magnetically connects the mobile device in a shooting mode.

Referring to FIG. 27, FIG. 27 is a schematic right-hand side view when the mobile device attachment in FIG. 25 magnetically connects the mobile device in a shooting mode. When the user needs to take photos or tape videos, the magnetic connecting member 100J can be unfolded relative to the lid 22J and extended in the escaping direction E, and the mobile device 3 can be magnetically connected and fixed on the magnetic connecting member 100J. Since the top 26J is located outside the image capturing range R, it is ensured that the entire lid 22J and the body part 24J below the lid 22J are located outside the image capturing range R, thus preventing the magnetic connecting member 100J, the connecting member 200J, or the container 2J from obscuring the subject.

Figure 28:
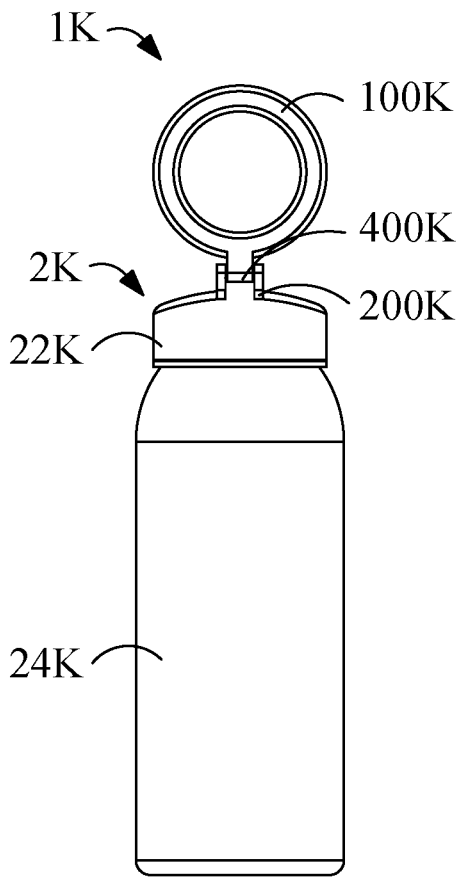
FIG. 28 is a schematic front view of the mobile device attachment and the container of another embodiment.

Referring to FIG. 28, FIG. 28 is a schematic front view of the mobile device attachment and the container of another embodiment. The mobile device attachment 1K and the container 2K of the present embodiment are roughly similar to the mobile device attachment 1J and the container 2J of the aforementioned embodiment, wherein the container 2K includes a lid 22K and a body part 24K, and the lid 22K may be disposed on the body part 24K in a way that is able to be opened or closed or detachably; and the mobile device attachment 1K includes a magnetic connecting member 100K, a connecting member 200K and a first pivot member 400K, wherein the connecting member 200K is disposed on the lid 22K, and the magnetic connecting member 100K can be pivotally connected to the connecting member 200K through the first pivot member 400K. The main difference between the two is that: the lid 22K is monotonically inclined downward, and the connecting member 200K is disposed on the top of the lid 22K.

Figure 29:
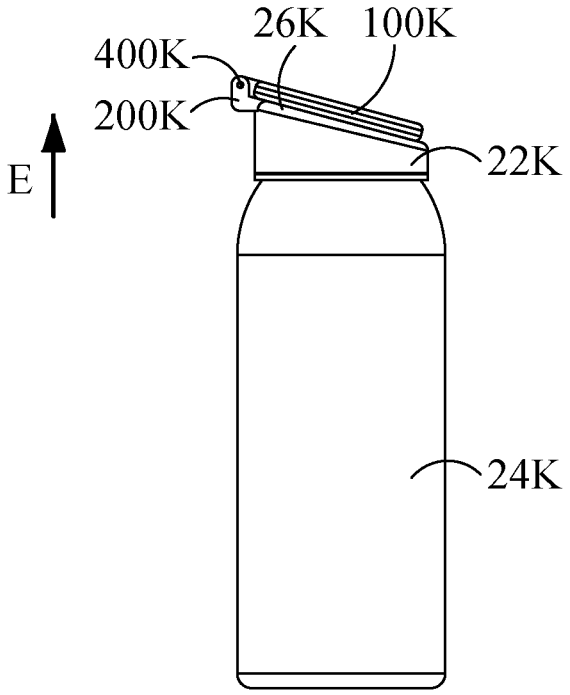
FIG. 29 is a schematic right-side view when the magnetic connecting member in FIG. 28 is in the folded position.
Figure 30:
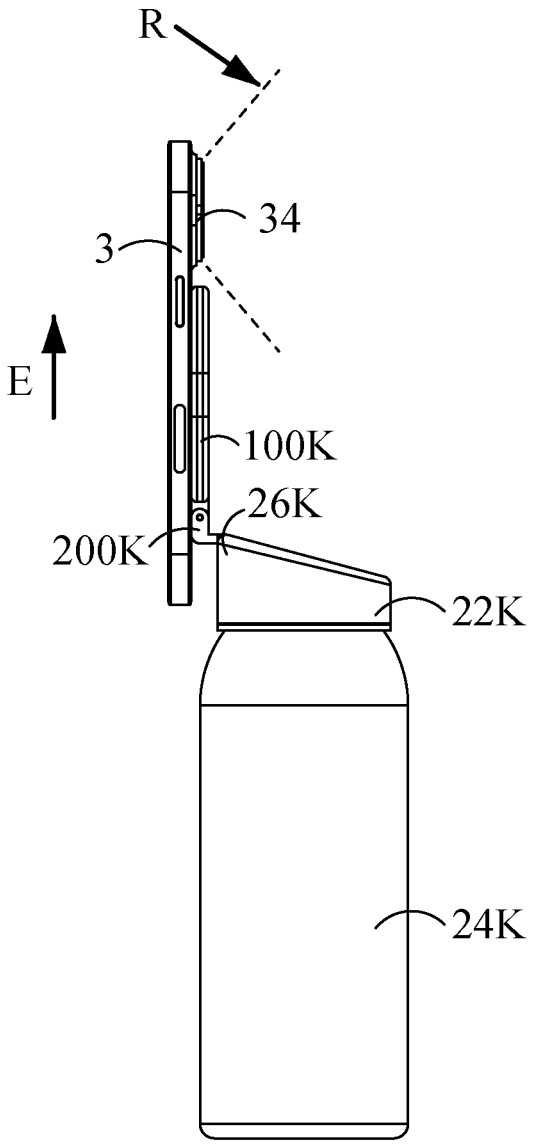
FIG. 30 is a schematic right-side view when the mobile device attachment in FIG. 28 magnetically connects the mobile device in a shooting mode.

Referring to FIGS. 29 and 30, FIG. 29 is a schematic right-side view when the magnetic connecting member in FIG. 28 is in the folded position, and FIG. 30 is a schematic right-side view when the mobile device attachment in FIG. 28 magnetically connects the mobile device in a shooting mode. In detail, the top surface of the lid 22K, for example, is monotonically inclined downward (that is, viewing from the side, the slope of the profile of the lid 22K from the bottom to the top is always smaller than or equal to zero), thus, when the magnetic connecting member 100K is folded relative to the lid 22K through the pivot of the first pivot member 400K, the entire magnetic connecting member 100K is fitted on the upper surface of the lid 22K, thereby improving the consistency of the appearance of the mobile device attachment 1K and the container 2K.

On the other hand, as shown in FIG. 29, the connecting member 200K is disposed on the top 26K of the lid 22K that is the most protruding in the escaping direction E, by such a configuration, when the user unfolds the magnetic connecting member 100K relative to the lid 22K and extends it in the escaping direction E as shown in FIG. 30, and magnetically connects and fixes the mobile device 3 on the magnetic connecting member 100K, since the top 26K is located outside the image capturing range R, it is ensured that the entire lid 22K and the body part 24K below the lid 22K are located outside the image capturing range R, thus preventing the magnetic connecting member 100K, the connecting member 200K, or the container 2K from obscuring the subject.

It is worth noting that in the embodiments of the container 2J and the container 2K, although the lid 22J that is inclined downward from the top 26J located in the center to the periphery and the lid 22K that is monotonically inclined downward from the top 26K located at one side to another side are respectively taken as examples, the present disclosure is not limited thereto. According to the actual design requirements, the upper surface of the lid can also be completely horizontal or trapezoidal (i.e., partially horizontal and then inclined downward), in which case the top can be regarded as every point on the horizontal surface located at a high place. In other words, as long as every point on the upper surface of the lid is located outside the image capture ranging R, the same effect as the container 2J and the container 2K can be achieved.

Figure 31:
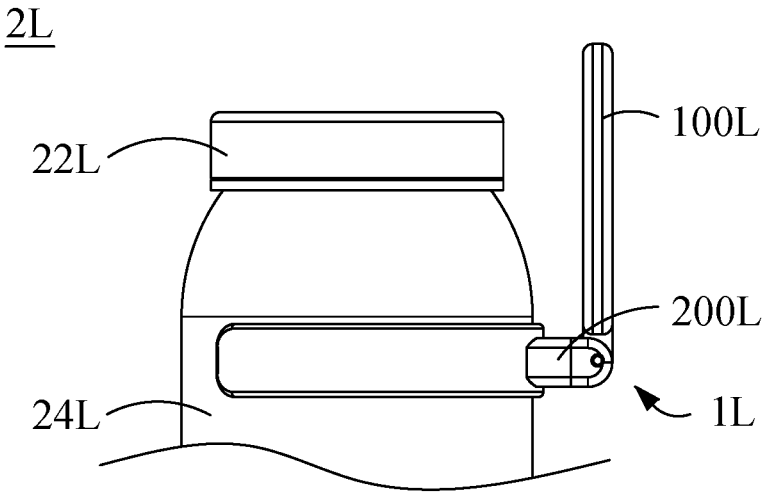
FIG. 31 is a schematic side view of the mobile device attachment and the container of another embodiment.
Figure 32:
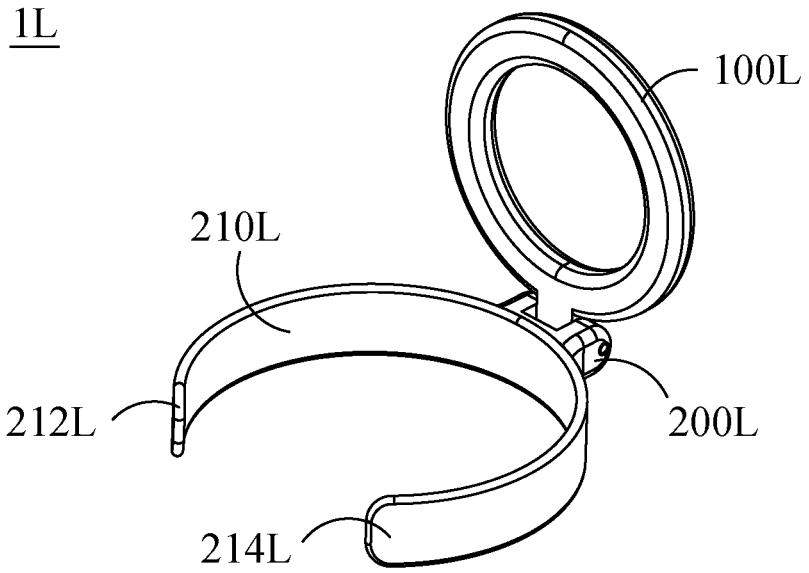
FIG. 32 is a schematic perspective view of the mobile device attachment in FIG. 31.

Referring to FIGS. 31 and 32, FIG. 31 is a schematic side view of the mobile device attachment and the container of another embodiment, and FIG. 32 is a schematic perspective view of the mobile device attachment in FIG. 31. The container 2L of the present embodiment includes a lid 22L and a body part 24L, and the lid 22L may be disposed on the body part 24L in a way that is able to be opened or closed or detachably; and the mobile device attachment 1L includes a magnetic connecting member 100L and a connecting member 200L, wherein the connecting member 200L, for example, is disposed on the body part 24L, and the magnetic connecting member 100L can be pivotally connected to the connecting member 200L. The main difference with the aforementioned mobile device attachment and container is that: the connecting member 200L of the mobile device attachment 1L includes a fastening part 210L, wherein the magnetic connecting member 100L is pivoted to the fastening part 210L, and the fastening part 210L is adapted for detachably fastening on the container 2L.

In detail, the fastening part 210L can be made of plastics or elastic nickel, titanium and other metals or alloys, for example, the shape is C-shaped, and can surround to have a fastening area substantially the same as an outer diameter of the body part 24L or slightly smaller than the outer diameter of the body 24L in a natural state. Further, the fastening part 210L includes a first end 212L and a second end 214L, when the fastening part 210L surrounds the body part 24L, a clearance is selectively formed between the first end 212L and the second end 214L, and the clearance may expand or contract with the outer diameter of the body part 24L. Thus, when the user wants to fix the mobile device 3 through the magnetic connecting member 100L, the fastening part 210L can be fastened to a peripheral surface of the body part 24L, so that the connecting member 200L can be fixed to the body part 24L, and the magnetic connecting member 100L can pivot relative to the body part 24L by the pivotal relation with the fastening part 210L. By such a configuration, when the container 2L is a water bottle with an outer diameter of the body part 24L roughly equal, the user can freely adjust the height of the mobile device attachment 1L relative to the body part 24L according to the needs of use, even if the outer diameter of the body part 24L has a slight change, because the fastening part 210L is made of elastic material, and there is a clearance between the first end 212L and the second end 214L, the fastening part 210L can expand or contract in accordance with the change of the outer diameter of the body part 24L, and maintain to attach on the surface of the body part 24L. When the user does not need to fix the mobile device 3, the magnetic connecting member 100L and the connecting member 200L can be quickly detached from the body part 24L, greatly improving the flexibility and convenience of use.

In addition, when the user shoots in a wide-angle mode, or the body part 24L obscures a shooting range of the mobile device 3, the user can slide the fastening part 210L to a relative high place of the body part 24L, and drive the magnetic connecting member 100L to extend in the escaping direction (such as the extension direction of the bottle body);

alternatively, the fastening part 210L can be detached from the body part 24L, and directly fastened to the lid 22L, and then the magnetic connecting member 100L is extended in the escaping direction, so that both the lid 22L and the body part 24L of the container 2L are located outside the image capturing range of the mobile device 3, thereby preventing the container 2L from obscuring the shooting content.

Figure 33:
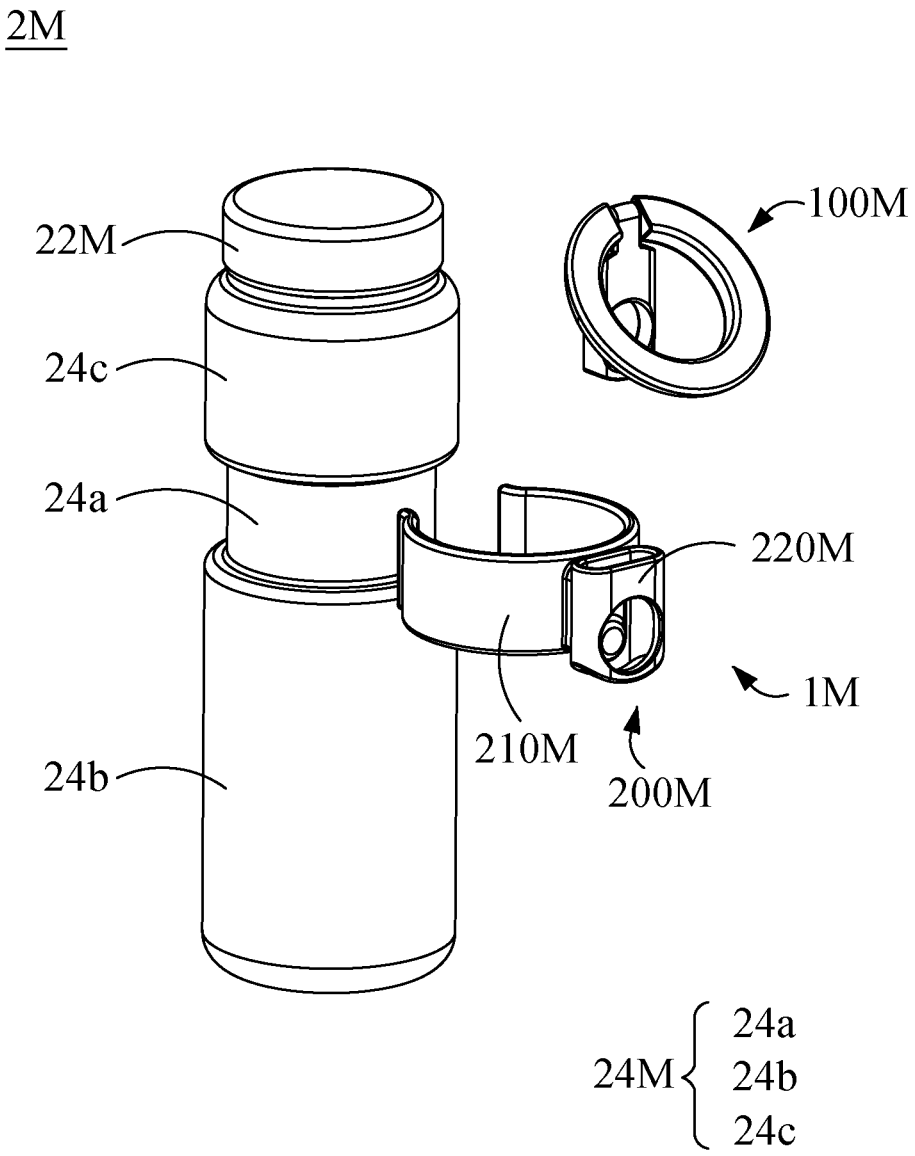
FIG. 33 is a schematic exploded view of the mobile device attachment and the container of another embodiment.
Figure 34:
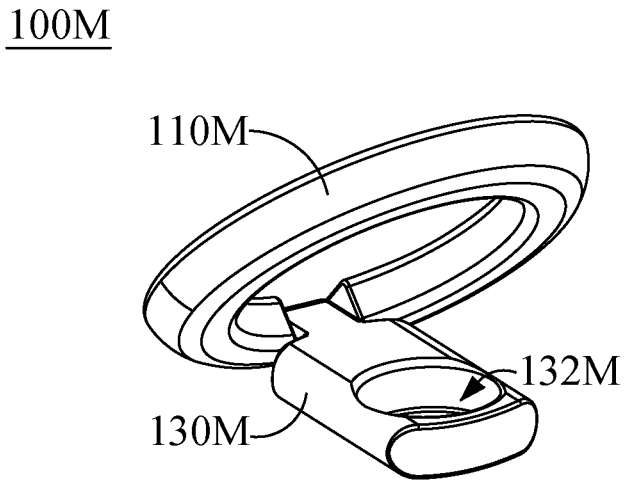
FIG. 34 is a schematic perspective view of the magnetic connecting member in FIG. 33.
Figure 35:
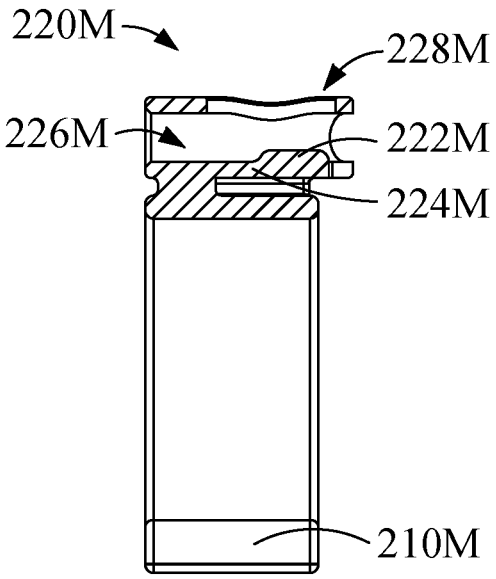
FIG. 35 is a schematic sectional view of the connecting member in FIG. 33.

Referring to FIGS. 33 to 35, FIG. 33 is a schematic exploded view of the mobile device attachment and the container of another embodiment, FIG. 34 is a schematic perspective view of the magnetic connecting member in FIG. 33, and FIG. 35 is a schematic sectional view of the connecting member in FIG. 33. The mobile device attachment 1M and the container 2M of the present embodiment are roughly similar to the mobile device attachment 1L and the container 2L of the aforementioned embodiment, wherein the container 2M includes a lid 22M and a body part 24M, and the lid 22M may be disposed on the body part 24M in a way that is able to be opened or closed or detachably; and the mobile device attachment 1M includes a magnetic connecting member 100M and a connecting member 200M, wherein the connecting member 200M includes a fastening part 210M, and the connecting member 200M is detachably disposed to the container 2M through the fastening part 210M. The main difference between the two is that: the magnetic connecting member 100M of the mobile device attachment 1M is detachably assembled to the connecting member 200M.

As shown in FIG. 34, the magnetic connecting member 100M may include a magnetic connecting part 110M and a first combination part 130M, wherein the magnetic connecting part 110M, for example, is ring-shaped and is used to selectively magnetically connect to the mobile device 3, and the first combination part 130M, for example, is in the shape of a flat plug, and a first stopping part 132M is formed on the first combination part 130M, wherein the first stopping part 132M, for example, is a through hole.

On the other hand, as shown in FIG. 35, the connecting member 200M may also include a second combination part 220M, wherein the second combination part 220M, for example, is a socket that can accommodate the above-described plug, and the second combination part 220M is fixed on the fastening part 210M. By such a configuration, when the user wants to magnetically connect the mobile device 3 on the container 2M, the connecting member 200M can be first fastened to the lid 22M or the body part 24M through the fastening part 210M, and then the first combination part 130M of the magnetic connecting member 100M is inserted in the second combination part 220M of the connecting member 200M, and finally the mobile device 3 is magnetically connected to the magnetic connecting part 110M, so as to achieve the effect of fixing the mobile device 3. It is worth mentioning that in the present embodiment although the first combination part 130M as a plug and the second combination part 220M as the corresponding socket are taken as an example, but the present disclosure is not limited thereto, in other possible embodiments, the first combination part 130M may also be designed as a sleeve, and the second combination 220M may be designed as a boss provided for the sleeve, or the two are designed as structures that can embed and match with each other, which can achieve the same effect.

Figure 36:
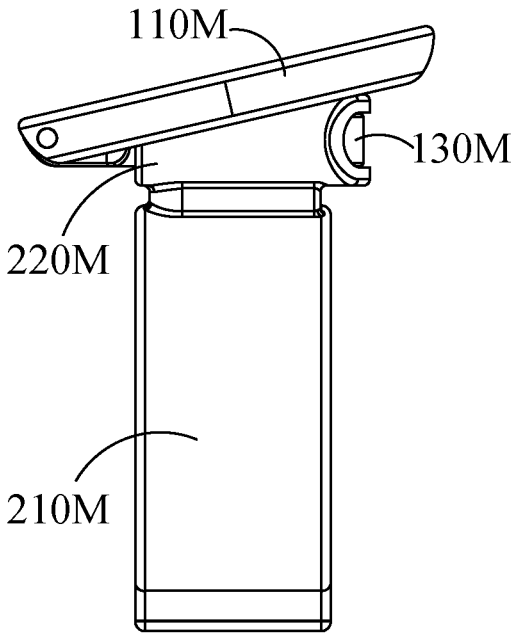
FIG. 36 is a schematic side view of the magnetic connecting member and the connecting member in FIG. 33 when they are connected to each other.
Figure 37:
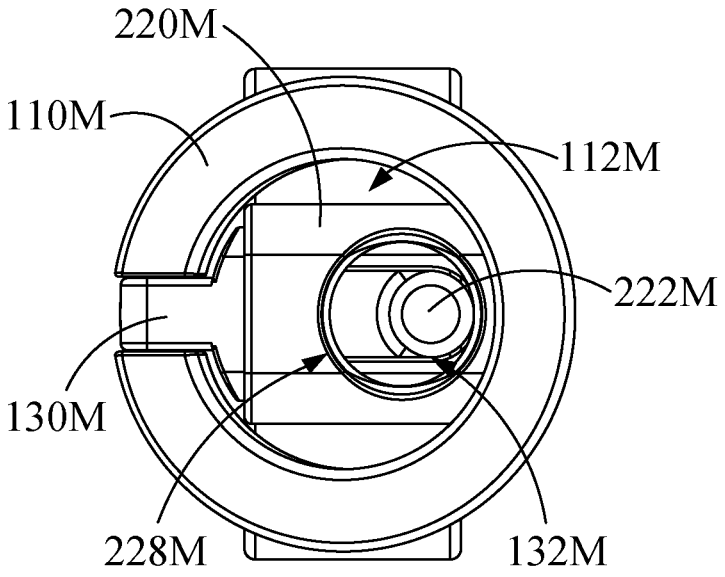
FIG. 37 is a schematic top view of FIG. 36.

Referring to FIGS. 35 to 37, FIG. 35 is a schematic sectional view of the connecting member in FIG. 33, FIG. 36 is a schematic side view of the magnetic connecting member and the connecting member in FIG. 33 when they are connected to each other, and FIG. 37 is a schematic top view of FIG. 36. Further, the second combination part 220M may include a second stopping part 222M and a cantilever 224M, wherein the second stopping part 222M, for example, is a bump corresponding to the first stopping part 132M, and the second stopping part 222M is disposed on a free end of the cantilever 224M. At the same time, the second combination part 220M can form a storage part 226M for storing the first combination part 130M, and the second stopping part 222M is disposed in the storage part 226M. By such a configuration, when the first combination part 130M is inserted into the storage part 226M, a front end of the first combination part 130M will contact the second stopping part 222M, and the second stopping part 222M is deflected by the elasticity of the cantilever 224M. When the first stopping part 132M and the second stopping part 222M are completely aligned, the second stopping part 222M will automatically fall into the first stopping part 132M, thus forming a stopping relation.

In some possible embodiments, the second combination part 220M may also form an opening 228M communicated to the storage part 226M. When the user wants to disassemble the first combination part 130M and the second combination part 220M, it only needs to insert the finger into the opening 228M, and press the first stopping part 132M or the second stopping part 220M to achieve the release effect, so it is conducive to the combination and disassembly of the magnetic connecting member 100M and the connecting member 200M.

Referring to FIG. 33 again, in the present embodiment, the body part 24M forms a mounting part 24*a*, and the fastening part 210M is adapted for fastening on the mounting part 24*a*. Specifically, the fastening part 210M is elastic, and an outer diameter of the mounting part 24*a* is substantially equal to or slightly larger than a clamping area defined by the fastening part 210M, so the fastening part 210M can securely clamp the mounting part 24*a*. In addition, the body part 24M may also include a supporting part 24*b*, the supporting part 24*b*, for example, is disposed to be lower than the mounting part 24*a* and has an outer diameter greater than the mounting part 24*a*. When the fastening part 210M is fastened to the mounting part 24*a*, an upper edge of the supporting part 24*b* can be abutted against a lower edge of the fastening part 210M. Therefore, even if the mobile device 3 magnetically connected to the magnetic connecting part 110M is heavier, the fastening part 210M can be prevented from sliding along the body part 24M through the abutting of the supporting part 24*b*.

In some possible embodiments, the body part 24M may also include an auxiliary supporting part 24*c*, and the auxiliary supporting part 24*c* is disposed between the lid 22M and the mounting part 24*a*. In other words, the mounting part 24*a* is disposed between the auxiliary supporting part 24*c* and the supporting part 24*b*. In addition, an outer diameter of the auxiliary supporting part 24*c* is also greater than the outer diameter of the mounting part 24*a*, and the auxiliary supporting part 24*c* and the supporting part 24*b* define the height of the mounting part 24*a*, and the height of the mounting part 24*a* is substantially equal to the height of the fastening part 210M. Thus, the user can quickly identify the position of the mounting part 24*a*, and the fastening part 210M is relatively easily fixed relative to the mounting part 24*a* by the abutting of the auxiliary supporting part 24*c* and the supporting part 24*b*.

When the user shoots in a wide-angle mode, or the body part 24M obscures a shooting range of the mobile device 3, the user can detach the fastening part 210M from the mounting part 24*a*, and change it to fasten to the lid 22M, the supporting part 24*b*, the auxiliary supporting part 24*c* or other appropriate positions, and extend the magnetic connecting member 100M in the escaping direction at the same time, so that all the lid 22M and the body part 24M of the container 2M are located outside the image capturing range of the mobile device 3, thereby preventing the container 2M from obscuring the shooting content.

While the present invention has been described by means of preferable embodiments, those skilled in the art should understand the above description is merely embodiments of the invention, and it should not be considered to limit the scope of the invention. It should be noted that all changes and substitutions which come within the meaning and range of equivalency of the embodiments are intended to be embraced in the scope of the invention, and without creating conceptual contradictions or structural conflicts, the technical features of the above embodiments may be appropriately combined, replaced, omitted and changed. Therefore, the scope of the invention is defined by the claims.

What is claimed is:

1. A mobile device attachment, adapted for a mobile device and a container for food or liquid, the mobile device attachment comprising:

a magnetic connecting member selectively magnetically connected to the mobile device and adapted to extend in an escaping direction; and a connecting member disposed between the container and the magnetic connecting member;

wherein the mobile device has an image capturing range, when the magnetic connecting member extends in the escaping direction, the container, the magnetic connecting member and the connecting member are located outside the image capturing range.

2. The mobile device attachment according to claim 1, further comprising an extending member, the extending member is disposed between the magnetic connecting member and the connecting member and adapted to extend in the escaping direction.

3. The mobile device attachment according to claim 2, wherein the extending member is detachably or pivotally connected to the connecting member.

4. The mobile device attachment according to claim 3, wherein the extending member comprises a first end part and a second end part spaced from the first end part, the first end part is pivoted to the magnetic connecting member, and the second end part is pivoted or detachably connected to the connecting member.

5. The mobile device attachment according to claim 3, wherein the extending member is selectively passing through or sleeved on the connecting member.

6. The mobile device attachment according to claim 5, wherein the extending member has a plurality of positioning parts, the connecting member comprises a positioning feature, and the positioning feature is selectively engaged with one of the plurality of positioning parts.

7. The mobile device attachment according to claim 5, further comprising a positioning member, the extending member has a positioning part, the connecting member has a positioning feature slidably connected to the positioning part, and the positioning member is adapted to fix the extending member relative to the connecting member.

8. The mobile device attachment according to claim 2, wherein one of the extending member and the magnetic connecting member has an accommodating part, and the accommodating part is adapted for accommodating at least a portion of the other one of the extending member and the magnetic connecting member.

9. The mobile device attachment according to claim 2, wherein the extending member comprises a plurality of pipe parts, the plurality of pipe parts are sleeved with each other and adapted to unfold or fold along the escaping direction.

10. The mobile device attachment according to claim 2, wherein the extending member is adapted to be magnetically connected to the magnetic connecting member or the mobile device.

11. The mobile device attachment according to claim 2, wherein the extending member has flexibility.

12. The mobile device attachment according to claim 2, wherein the container comprises a mounting member, the connecting member is disposed on the mounting member, and the extending member or the magnetic connecting member is selectively attached on one surface of the mounting member.

13. The mobile device attachment according to claim 1, wherein the magnetic connecting member comprises an extending part, and the extending part extends in the escaping direction.

14. The mobile device attachment according to claim 13, wherein the mobile device has a magnetic connecting feature, the magnetic connecting member further comprises a first magnetic connecting part and a second magnetic connecting part, the extending part is disposed between the first magnetic connecting part and the second magnetic connecting part, and the magnetic connecting feature is selectively magnetically connected to the first magnetic connecting part or the second magnetic connecting part.

15. The mobile device attachment according to claim 1, wherein the connecting member comprises a fastening part, and the fastening part is adapted to be detachably disposed on the container.

16. The mobile device attachment according to claim 15, wherein the magnetic connecting member comprises:

a magnetic connecting part configured to be selectively magnetically connected to the mobile device; and a first combination part pivoted to the magnetic connecting part;

wherein the connecting member further comprises a second combination part connected to the fastening part, and the second combination part is adapted to detachably assemble with the first combination part.

17. The mobile device attachment according to claim 15, wherein the fastening part is elastic and comprises a first end and a second end, and a clearance is selectively formed between the first end and the second end.

18. The mobile device attachment according to claim 1, wherein the magnetic connecting member has a first surface and a second surface opposite to the first surface, and the mobile device is selectively attached on the first surface or the second surface.

19. A container for food or liquid, comprising:

a mounting member; and the mobile device attachment according to claim 1, and the connecting member is disposed on the mounting member.

20. The container according to claim 19, wherein the mounting member forms a groove thereon, and the groove is adapted to accommodate at least a portion of the magnetic connecting member.

21. The container according to claim 19, wherein the mobile device attachment further comprises an extending member, the extending member is disposed between the magnetic connecting member and the connecting member, the mounting member forms a groove thereon, and the groove is adapted to accommodate at least a portion of the extending member.

22. The container according to claim 19, wherein a top of the mounting member in the escaping direction is located outside the image capturing range.

23. The container according to claim 22, wherein the connecting member is disposed on the top.

* * * * *